US010578990B2

(12) United States Patent
Tsuda et al.

(10) Patent No.: US 10,578,990 B2
(45) Date of Patent: Mar. 3, 2020

(54) TONER

(71) Applicant: CANON KABUSHIKI KAISHA, Tokyo (JP)

(72) Inventors: Shohei Tsuda, Suntou-gun (JP); Daisuke Yoshiba, Suntou-gun (JP); Kozue Uratani, Mishima (JP); Mariko Yamashita, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/043,732

(22) Filed: Jul. 24, 2018

(65) Prior Publication Data

US 2019/0041763 A1 Feb. 7, 2019

(30) Foreign Application Priority Data

Aug. 4, 2017 (JP) ..... 2017-151594

(51) Int. Cl.
*G03G 9/087* (2006.01)
*G03G 9/08* (2006.01)

(52) U.S. Cl.
CPC ..... *G03G 9/08755* (2013.01); *G03G 9/0827* (2013.01); *G03G 9/08702* (2013.01)

(58) Field of Classification Search
CPC ..... G03G 9/08755; G03G 9/08782; G03G 9/08795; G03G 9/08797; G03G 9/08708
See application file for complete search history.

(56) References Cited

U.S. PATENT DOCUMENTS

| | | | |
|---|---|---|---|
| 6,613,491 | B2 | 9/2003 | Inoue et al. |
| 7,537,877 | B2 | 5/2009 | Yoshiba et al. |
| 7,544,455 | B2 | 6/2009 | Yoshiba et al. |
| 7,700,254 | B2 | 4/2010 | Moribe et al. |
| 7,740,998 | B2 | 6/2010 | Yamazaki et al. |
| 7,796,926 | B2 | 9/2010 | Matsuda et al. |
| 7,855,042 | B2 | 12/2010 | Kobori et al. |
| 8,043,781 | B2 | 10/2011 | Imafuku et al. |
| 8,057,977 | B2 | 11/2011 | Moribe et al. |

(Continued)

FOREIGN PATENT DOCUMENTS

| | | |
|---|---|---|
| JP | H 04-081771 | 3/1992 |
| JP | 2002-214825 | 7/2002 |

(Continued)

OTHER PUBLICATIONS

U.S. Appl. No. 16/047,413, Daisuke Yoshiba, filed Jul. 27, 2018.

*Primary Examiner* — Peter L Vajda
(74) *Attorney, Agent, or Firm* — Venable LLP

(57) ABSTRACT

A toner comprising a toner particle that contains a binder resin and a colorant, wherein (1) an average circularity of the toner is at least 0.960, (2) an onset temperature Tε (° C.) of a storage elastic modulus E' of the toner, as determined by a powder dynamic viscoelastic measurement, is from 50° C. to 70° C., and (3) in a differential curve obtained by differentiation, by load, of a load-displacement curve provided by measurement of the strength of the toner by a nanoindentation procedure, with the horizontal axis being load (mN) and the vertical axis being displacement (μm), the load X that provides the maximum value in the differential curve in the load region from 0.20 mN to 2.30 mN is from 1.00 mN to 1.50 mN.

13 Claims, 5 Drawing Sheets

(56) References Cited

U.S. PATENT DOCUMENTS

| | | | | |
|---|---|---|---|---|
| 8,703,378 | B2 | 4/2014 | Satoh et al. | |
| 8,918,035 | B2 | 12/2014 | Hasegawa et al. | |
| 9,097,998 | B2 | 8/2015 | Yamazaki et al. | |
| 9,128,400 | B2 | 9/2015 | Takahashi et al. | |
| 9,201,323 | B2 | 12/2015 | Nishikawa et al. | |
| 9,244,371 | B2 | 1/2016 | Suzumura et al. | |
| 9,250,548 | B2 | 2/2016 | Nomura et al. | |
| 9,261,804 | B2 | 2/2016 | Yamazaki et al. | |
| 9,304,422 | B2 | 4/2016 | Matsui et al. | |
| 9,341,970 | B2 | 5/2016 | Yoshiba et al. | |
| 9,348,246 | B2 | 5/2016 | Magome et al. | |
| 9,354,545 | B2 | 5/2016 | Matsui et al. | |
| 9,377,708 | B2 | 6/2016 | Magome et al. | |
| 9,423,712 | B2 | 8/2016 | Sugama et al. | |
| 9,442,416 | B2 | 9/2016 | Magome et al. | |
| 9,470,993 | B2 | 10/2016 | Nishikawa et al. | |
| 9,575,425 | B2 | 2/2017 | Naka et al. | |
| 9,588,450 | B2 | 3/2017 | Tsuda et al. | |
| 9,606,462 | B2 | 3/2017 | Nomura et al. | |
| 9,625,842 | B2 | 4/2017 | Uratani et al. | |
| 9,658,546 | B2 | 5/2017 | Tanaka et al. | |
| 9,715,188 | B2 | 7/2017 | Terauchi et al. | |
| 9,772,570 | B2 | 9/2017 | Tsuda et al. | |
| 9,778,583 | B2 | 10/2017 | Terauchi et al. | |
| 9,804,514 | B2 | 10/2017 | Suzumura et al. | |
| 9,829,818 | B2 | 11/2017 | Yoshiba et al. | |
| 9,841,692 | B2 | 12/2017 | Hasegawa et al. | |
| 9,857,707 | B2 | 1/2018 | Tsuda et al. | |
| 9,904,195 | B2 | 2/2018 | Matsui et al. | |
| 9,964,874 | B2 | 5/2018 | Suzumura et al. | |
| 9,971,263 | B2 | 5/2018 | Fukudome et al. | |
| 10,012,919 | B2 | 7/2018 | Matsui et al. | |
| 2011/0151368 | A1* | 6/2011 | Hong | G03G 9/0819 430/108.8 |
| 2012/0219892 | A1* | 8/2012 | Ohno | G03G 9/0906 430/45.5 |
| 2013/0183617 | A1* | 7/2013 | Eida | G03G 9/0812 430/109.4 |
| 2013/0252167 | A1 | 9/2013 | Moribe et al. | |
| 2014/0004460 | A1 | 1/2014 | Yoshiba et al. | |
| 2015/0086917 | A1 | 3/2015 | Iwasaki et al. | |
| 2015/0125790 | A1 | 5/2015 | Hotta et al. | |
| 2015/0185658 | A1 | 7/2015 | Wakabayashi et al. | |
| 2015/0220013 | A1 | 8/2015 | Nishikawa et al. | |
| 2015/0227069 | A1* | 8/2015 | Sugama | G03G 9/08733 430/109.4 |
| 2016/0091809 | A1* | 3/2016 | Tsuda | G03G 9/083 430/108.7 |
| 2016/0139522 | A1 | 5/2016 | Yoshiba et al. | |
| 2016/0161874 | A1 | 6/2016 | Yamazaki et al. | |
| 2016/0202624 | A1 | 7/2016 | Nishikawa et al. | |
| 2016/0266509 | A1 | 9/2016 | Sano et al. | |
| 2016/0378003 | A1 | 12/2016 | Arimura et al. | |
| 2017/0160662 | A1 | 6/2017 | Nagashima et al. | |
| 2018/0004108 | A1 | 1/2018 | Tsuda et al. | |
| 2018/0004109 | A1 | 1/2018 | Matsui et al. | |
| 2018/0173125 | A1 | 6/2018 | Fukudome et al. | |
| 2018/0173126 | A1 | 6/2018 | Ohmori et al. | |
| 2018/0246430 | A1 | 8/2018 | Tanaka et al. | |
| 2018/0246432 | A1 | 8/2018 | Nishikawa et al. | |
| 2019/0041762 | A1 | 2/2019 | Yoshiba et al. | |

FOREIGN PATENT DOCUMENTS

| | | | |
|---|---|---|---|
| JP | 2005-270955 | | 10/2005 |
| JP | 2005-300937 | A | 10/2005 |
| JP | 2008-164771 | A | 7/2008 |
| JP | 2009-036980 | | 2/2009 |
| JP | 2009-109661 | | 5/2009 |
| JP | 2012-063636 | | 3/2012 |
| JP | 2013-109018 | | 6/2013 |
| JP | 2015-125271 | | 7/2015 |
| JP | 2015-152703 | A | 8/2015 |
| JP | 2016-038591 | | 3/2016 |
| JP | 2016-126220 | | 7/2016 |
| JP | 2016-139062 | | 8/2016 |
| JP | 2016-139063 | | 8/2016 |
| JP | 2016-142758 | | 8/2016 |
| JP | 2016-142788 | | 8/2016 |
| JP | 2016-142811 | | 8/2016 |
| WO | 2013/063291 | | 5/2013 |
| WO | 2019/027039 | | 2/2019 |

* cited by examiner

TONER

BACKGROUND OF THE INVENTION

Field of the Invention

The present invention relates to a toner used in image-forming methods for visualizing electrostatic images in electrophotography.

Description of the Related Art

The use of copiers and printers has changed in recent years from the use of one machine by a number of individuals to the use of a single machine by a single individual. In addition, improvement in business operation efficiency has been paid more attention to, and in addition to a long service life and high image quality, further reductions in size and higher speeds are required of these devices.

Reducing the size of the process cartridge, where the developer is stored, and reducing the size of the fixing unit installed in the main unit are effective for achieving size reductions. The adoption of a cleanerless system is an example of an effective means for downsizing the process cartridge. A cleanerless system can make a substantial contribution to downsizing the machine profile because cleanerless systems lack a cleaning blade and a waste toner box.

In a cleanerless system, the untransferred toner, after its passage through the charging step, is recovered to the toner container and is again transported to the developing step. The stress applied to the toner is thus larger than in cleaning blade-equipped systems, and deformation, e.g., cracking and breakage of the toner particle, then occurs and irregularly shaped particles may remain in the cartridge. This toner particle cracking and breakage in particular occur to a substantial degree in contact developing systems and under conditions in which members such as the toner carrying member and regulating blade become harder, e.g., low-temperature, low-humidity environments. It is difficult for the thusly produced irregularly shaped particles to take on a uniform charge and they also become a "fogging" component that ultimately develops into non-image areas on the electrostatic latent image bearing member.

Reducing the size of the fixing unit is another example of an effective means for achieving downsizing. In order to reduce the size of the fixing unit, simplification of the heat source and apparatus structure is readily achieved in the case of film fixing and is thus easily applied. However, film fixing generally uses a small amount of heat and low pressures, and as a consequence the potential exists for an inadequate transfer of heat to the toner. In addition, higher printer speeds have also imposed more challenging conditions on the fixing operation.

For example, when a full-surface solid black image is printed out, an adequate amount of heat is not transferred to the toner and toner melting is impaired and the toner-to-paper or toner-to-toner adhesiveness is then poor. Because the heat from the fixing unit is taken up by the toner laid on the front half of the paper, melting of the toner transferred to the back end of the paper in particular is even more substantially impaired. As a result, toner at the back end attaches in part to the fixing film and an image defect occurs in which toner ends up attaching to more rearward white background areas of the paper (referred to below as back-end offset).

In addition, in high-humidity environments, the heat is further siphoned off by moisture and the production of back-end offset is even more prone to occur. When, on the other hand, the melt viscosity of the toner is lowered in order to solve this problem, cracking and breakage of the toner particle can be produced as above.

In order to solve the aforementioned problems produced in pursuit of higher speeds and smaller machine sizes, it becomes necessary to provide a toner that can be fixed at low pressures with small amounts of heat and that is resistant to the fogging produced by toner cracking and breakage.

Various methods of toner improvement have been proposed in response to the aforementioned problems.

For example, Japanese Patent Application Laid-open No. 2005-300937 proposes a toner for which the mechanical stability, charging characteristics, transfer characteristics, and fixing characteristics of the toner particle are improved.

In addition, Japanese Patent Application Laid-open No. 2008-164771 proposes a toner that, through control of the elastic modulus of the toner using a Nano Indenter (registered trademark), can provide a stable high-quality image on a long-term basis.

Japanese Patent Application Laid-open No. 2015-152703 describes a toner having a toner particle that contains a colorant and a binder resin that contains an amorphous resin (A) and an amorphous polyester resin (B), wherein the amorphous polyester resin (B) is dispersed as a domain phase in a matrix phase containing the amorphous resin (A). A prescribed range is given for the size of the number-average domain diameter in an observed image of the toner particle cross section.

SUMMARY OF THE INVENTION

However, in the case of Japanese Patent Application Laid-open No. 2005-300937, there is still room to improve the mechanical stability in systems in which greater load is applied to the toner, such as cleanerless systems and contact developing systems.

While Japanese Patent Application Laid-open No. 2008-164771 does provide excellent results with regard to, e.g., the fixing performance, image density nonuniformity, and fogging, there is still room for improvement with regard to the mechanical strength of the toner.

When Japanese Patent Application Laid-open No. 2015-152703 was applied to cleanerless systems, in some cases toner particle cracking and breakage occurred and fogging could not be suppressed.

In view of the preceding, there is still room for improvement, in low-temperature and high-humidity environments and anticipating the higher speeds and smaller machine sizes of the future, with regard to achieving suppression of the fogging caused by toner particle cracking and breakage and suppression of back-end offset.

An object of the present invention is to provide a toner that solves these problems.

That is, an object of the present invention is to provide a toner that can suppress fogging and back-end offset during long-term use in low-temperature, high-humidity environments.

The present invention relates to a toner comprising a toner particle that contains a binder resin and a colorant, wherein (1) an average circularity of the toner is at least 0.960, (2) an onset temperature $T\varepsilon$ (° C.) of a storage elastic modulus E' of the toner, as determined by a powder dynamic viscoelastic measurement, is from 50° C. to 70° C., and (3) in a differential curve obtained by differentiation, by load, of a load-displacement curve provided by measurement of the strength of the toner by a nanoindentation procedure, with the horizontal axis being load (mN) and the vertical axis being displacement (μm), the load X that provides a maximum value in the differential curve in the load region from 0.20 mN to 2.30 mN is from 1.00 mN to 1.50 mN.

The present invention can thus provide a toner that can suppress fogging and back-end offset during long-term use in low-temperature, high-humidity environments.

Further features of the present invention will become apparent from the following description of exemplary embodiments with reference to the attached drawings.

DESCRIPTION OF THE EMBODIMENTS

Figure 1:
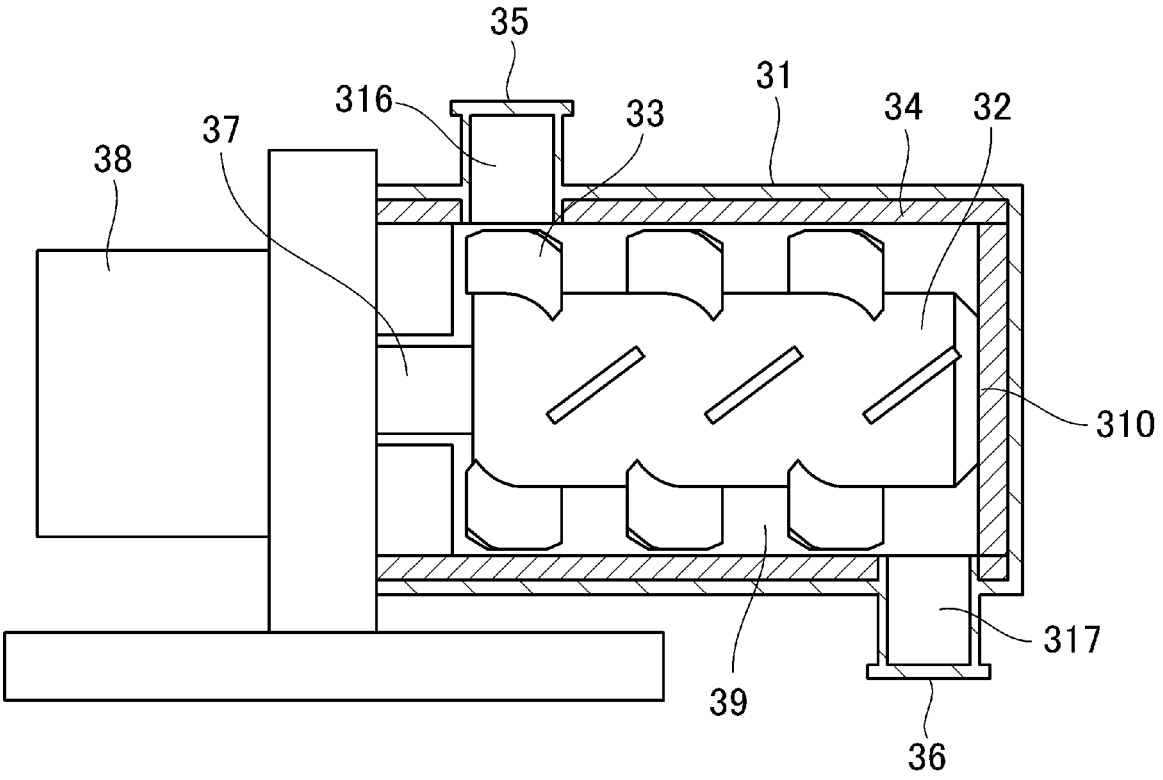
FIG. 1 is a schematic diagram that shows an example of a mixing process apparatus.

Unless specifically indicated otherwise, expressions such as "from XX to YY" and "XX to YY" that show numerical value ranges refer in the present invention to numerical value ranges that include the lower limit and upper limit that are the end points.

As previously indicated, for example, cleanerless systems and film fixing have been adopted in order to achieve the downsizing required of printers in recent years.

In a cleanerless system, the untransferred toner passes through the charging step and is recovered to the toner container and is again transported to the developing step. Due to this, rubbing between the toner and regulating blade occurs a large number of times, creating the potential for toner particle cracking and breakage to occur and for the charge distribution to broaden and as a result facilitating the occurrence of fogging.

Investigations by the present inventors have shown that toner particle cracking and breakage become more of a disadvantage as the environmental temperature declines. The reason for this is as follows: the mechanical force applied to the toner is increased due to the increased hardness of members such as the charging member and regulating blade, and as a result brittle fracture of the toner particle itself is promoted.

In addition, toner particle cracking and breakage is also affected by the state of occurrence of inorganic fine particles, e.g., silica fine particles, present on the toner particle surface. That is, when the toner is subjected to mechanical stress, and when inorganic fine particles are present on the toner particle surface, the area of contact is reduced and the mechanical stress can be dispersed. However, due to long-term use within the cartridge, the inorganic fine particles on the toner particle surface can undergo transfer from the toner particle surface to another cartridge member, for example, the charging member. As a result, maintenance of the desired charging performance by the electrostatic latent image bearing member is impaired and image defects can then occur. At the same time, the inorganic fine particles on the toner particle surface, which function to disperse mechanical stress, are reduced in number, and due to this the occurrence of toner particle cracking and breakage is facilitated.

Accordingly, when the hardness of the toner is increased with the goal of suppressing toner particle cracking and breakage, attachment of the inorganic fine particles to the toner particle surface is impaired and, conversely, transfer of the inorganic fine particles to other members is further promoted. As a result, the electrostatic latent image bearing member cannot maintain the desired charging performance and the occurrence of image defects is then facilitated. At the same time, a deficient melt-spreading by the toner during fixing is facilitated and a decline in the fixing performance, e.g., the occurrence of back-end offset and so forth, is facilitated.

On the other hand, with regard to film fixing, film fixing generally uses small amounts of heat and low pressures, and due to this the potential exists for an inadequate transfer of heat to the toner. In addition, in recent years there have also been quite a number of examples, when considered globally, of the use of printers in diverse environments, and in high-humidity environments in particular, the heat is siphoned off by the moisture and the amount of heat applied to the toner is then even smaller.

When the temperature of the fixing film is too low, the toner does not undergo satisfactory melting and a temperature gradient is produced within the toner layer. The interfacial temperature between the lowermost side of the toner layer and the paper surface then assumes a temperature inadequate for causing the toner to melt and the toner layer undergoes rupture. The problem of cold offset—wherein the toner attaches to the fixing film during passage through the fixing nip and, after one rotation in this state, is fixed to the paper—is produced as a result.

In the case of a large toner laid-on level on the paper during the print out of a high print percentage image, such as full-surface solid black, the amount of heat applied per individual toner particle is low and the occurrence of this cold offset phenomenon at the back end of the paper is facilitated in particular (referred to as back-end offset). This occurs because the heat from the fixing unit is siphoned off by the toner laid on the front half of the paper, which impairs melting by the toner transferred to the back end of the paper.

The present inventors investigated the toner residing on the paper for a full-surface solid black image that had been fixed at the lowest temperature at which this back-end offset did not appear. It was found that this toner was fixed in a state in which just the surface was melted and connected, with particle clumps remaining as such, and that toner particle-to-toner particle adhesion was a surface adhesion. That is, back-end offset was found to be a phenomenon that occurred due to a deficient toner particle-to-toner particle adhesion. Thus, in order to suppress back-end offset, the toner particle-to-toner particle adhesiveness must be improved by having the toner particle surface melt and exhibit viscosity at lower temperatures.

However, when, as the means for achieving this, the melt viscosity of the toner is simply reduced, brittle fracture of the toner particle itself and the occurrence of fogging are facilitated in the case of use in a system in which greater loads are applied to the toner, such as cleanerless systems.

Based on the preceding, the suppression of cracking and breakage and the suppression of back-end offset were in a trade-off relationship with each other, and inducing them to coexist with each other in good balance was problematic when considering the higher speeds and longer service life of printers in challenging environments.

The present invention can bring about—in systems in which greater loads are applied to the toner, such as cleanerless systems, and even in low-temperature, high-humidity environments—a thorough suppression of toner particle cracking and breakage while at the same time suppressing back-end offset.

That is, it was discovered, for a toner having a toner particle that contains a binder resin and a colorant, that the aforementioned problems could be solved by satisfying the following essential conditions.

That is, the toner according to the present invention has the following characteristic features:

(1) an average circularity of the toner is at least 0.960, (2) an onset temperature Tε (° C.) of a storage elastic modulus E' of the toner, as determined by a powder dynamic viscoelastic measurement, is from 50° C. to 70° C., and (3) in a differential curve obtained by differentiation, by load, of a load-displacement curve provided by measurement of the strength of the toner by a nanoindentation procedure, with the horizontal axis being load (mN) and the vertical axis being displacement (μm), the load X that provides a maximum value in the differential curve in the load region from 0.20 mN to 2.30 mN is from 1.00 mN to 1.50 mN.

The present inventors first carried out investigations with regard to toner strength that could be maintained even in a low-temperature environment. Nanoindentation was adopted as the index of toner strength for the present invention. A nanoindentation procedure is an evaluation method in which a diamond indenter is pressed into the sample mounted on a stage; the load (pressing force) and displacement (depth of insertion) are measured; and the mechanical properties are analyzed using the resulting load-displacement curve.

Microcompression testers have been used to evaluate the mechanical properties of toners, but they are suitable for evaluating the macromechanical properties of toners because the indenter used in microcompression testers is larger than the size of a toner particle.

However, property evaluation in a smaller region is required because the toner particle cracking and breakage that are the focus of the present invention—and particularly the cracking—are affected by the micromechanical properties of the toner particle surface. In measurements using a nanoindentation procedure, the indenter has a triangular pyramidal shape and the tip of the indenter is substantially smaller than the size of a toner particle. As a consequence, a nanoindentation procedure is suitable for evaluating the micromechanical properties of the toner particle surface.

As a result of intensive investigations, the present inventors discovered that, with regard to the mechanical properties of toner, controlling the load measured by nanoindentation into a special range is crucial.

Thus, in the differential curve obtained by the differentiation, by load, of the load-displacement curve provided by measurement of the strength of the toner by a nanoindentation procedure wherein the horizontal axis is load (mN) and the vertical axis is displacement (μm), a characteristic feature of the present invention is that the load X that provides the maximum value in the differential curve in the load region from 0.20 mN to 2.30 mN is from 1.00 mN to 1.50 mN.

In a nanoindentation measurement, the displacement is measured while pressing the indenter into the sample by the continuous application of a very small load to the toner, and a load-displacement curve is then constructed placing the load (mN) on the horizontal axis and the displacement (μm) on the vertical axis.

At the load in the load-displacement curve where the displacement from the load reaches a maximum, the toner particle undergoes a large deformation, i.e., it is thought that a phenomenon corresponding to cracking is produced. The load that provides the largest slope in this load-displacement curve was therefore used in the present invention as the load at which toner particle cracking is produced. That is, a larger load at which the largest slope occurs indicates that the load required for toner particle cracking is also larger and that toner particle cracking is thus made more difficult.

The procedure in the present invention for determining the load that provides the largest slope was to use the load at which the value of the derivative assumed a maximum value in the differential curve provided by differentiating the load-displacement curve by load.

In specific terms, a characteristic feature is that in the differential curve obtained by the differentiation, by load, of the load-displacement curve, the load X that provides the maximum value in the differential curve in the load region from 0.20 mN to 2.30 mN is from 1.00 mN to 1.50 mN. From 1.10 mN to 1.50 mN is preferred, while from 1.20 mN to 1.50 mN is more preferred.

Controlling the load X into the indicated range provides a certain effect in terms of inhibiting toner particle cracking and breakage in cleanerless systems, particularly in low-temperature environments.

A higher value for the load X indicates a higher toner strength and an easier inhibition of toner particle cracking. However, the generation of back-end offset is facilitated when the load X is higher than 1.50 mN, and as a consequence the load X has to be not more than 1.50 mN. The load X can be controlled through the molecular weight of the toner, the amount of THF-insoluble matter in the toner, the heating temperature and heating time during the heating step, and the peripheral velocity during mixing.

The reason for specifying a load range of from 0.20 mN to 2.30 mN in the determination of the differential curve is as follows.

During long-term use, stress is frequently applied to the toner at between the regulating blade and toner carrying member within the cartridge. During their investigations the present inventors discovered that the strength measured using a loading rate that applies a load of 2.50 mN in 100 seconds provides a good correlation between the phenomenon of long-term use-induced toner particle cracking and the condition of measurement by nanoindentation. Moreover, it was discovered that the load range for determining the differential curve of from 0.20 mN to 2.30 mN is optimal for minimizing sample-to-sample variations and variations due to the measurement conditions.

In addition, measurement of the toner by a nanoindentation procedure is strongly affected by the shape of the toner. The average circularity of the toner is thus crucial, and it was discovered that the evaluation could be carried out with good reproducibility when the average circularity was at least 0.960. Moreover, it was discovered that the average circularity of the toner is also a crucial factor for lessening the stress applied in the cartridge.

At less than 0.960, unevenness forms in the toner surface and as a consequence a "hooked" condition is assumed toner-to-toner or toner-to-cartridge-member. As a result, the stress applied to the toner is increased, which is unfavorable with regard to toner particle cracking. The average circularity of the toner is preferably at least 0.970, and, while there are no particular limitations on the upper limit, 1.000 or less is preferred.

Cracking and breakage are inhibited when the toner strength is increased as described in the preceding. However, a characteristic feature of the present invention is that the low-temperature fixing performance, e.g., the back-end offset in a high-humidity environment, is also substantially improved at the same time by a design in which not just solely the toner strength is improved, but melting of the toner particle surface is also promoted.

Investigations were carried out into the viscoelastic properties of toner that would be able to suppress this back-end offset in a high-humidity environment.

A powder dynamic viscoelastic measurement (DMA below) can measure toner as such as a powder. As a result of investigations by the present inventors, it was discovered that, by adjusting the ramp rate in the powder dynamic viscoelastic measurement, the measured onset temperature Tε (° C.) of the storage elastic modulus E' strongly corresponds to the viscoelasticity of the toner particle surface.

In conventional viscoelastic measurements, the measurement is generally run after the toner has been molded using heat and/or pressure, and as a consequence these measurement results can be regarded as indicating the viscoelastic characteristics averaged over the entire toner and are thought to be unable to represent the properties of the toner particle surface. Powder dynamic viscoelastic measurements, on the other hand, can be measured on the toner as such as a powder and are thus thought to be able to strongly reflect the state of the toner particle surface. When the contents of the measurement cell used in this measurement were observed during temperature ramp up, a state was observed in which toner particle-to-toner particle adhesion was beginning to occur at the onset temperature Tε.

As indicated above, the toner residing on the paper for a full-surface solid black image fixed at the lowest temperature at which back-end offset does not appear, is fixed in a state in which just the surface is melted and connected, with particle clumps remaining as such, and the toner particles are surface-adhered with each other. As a result of additional investigations, it was found that the onset temperature Tε provided by powder dynamic viscoelastic measurements is the temperature at which the elastic modulus of the toner particle surface declines and viscosity begins to be appear and is a value that strongly correlates with the minimum temperature at which toner particle-to-toner particle adhesion begins to occur and back-end offset does not appear.

When the onset temperature Tε of the storage elastic modulus E' is from 50° C. to 70° C., melting in the vicinity of the toner particle surface occurs at lower temperatures and back-end offset can be suppressed. When Ts is less than 50° C., during exposure to high-temperature environments during international transport, the toner particle surface undergoes softening and the charging stability and flowability decline and fogging is ultimately produced due to, e.g., burying of the external additive. In addition, the storage elastic modulus takes on a declining trend and the occurrence of toner particle cracking and breakage is facilitated and the generation of fogging after long-term use is also facilitated at the same time.

When Tε is higher than 70° C., melting in the vicinity of the toner particle surface does not occur at lower temperatures, and the generation of back-end offset is then facilitated when the fixing unit provides a small amount of heat. Tε is preferably from 55° C. to 65° C.

Control in order to optimize Ts can be carried out by adjusting the type, amount, and location of occurrence of the release agent and/or amorphous polyester, the molecular weight of the toner, and the amount of THF-insoluble matter in the toner.

For example, when a release agent is used in the toner, Tε can be lowered by increasing the amount of release agent in the vicinity of the surface. When an amorphous polyester is used in the toner, surface melting can be further promoted and Tε can be reduced by using a release agent that has a structure similar to that of amorphous polyester resin, for example, an ester wax. A reduction in Ts may also be readily accomplished by reducing the molecular weight of the toner or reducing the THF-insoluble matter therein.

According to investigations by the present inventors, a trade-off relationship was present between the suppression of toner particle cracking and breakage, which could be evaluated by nanoindentation as described above, and the suppression of back-end offset, which could be evaluated by powder dynamic viscoelastic measurements. Moreover, inducing them to coexist with each other was problematic for conventional toner design and toner technology when considering the higher speeds, smaller sizes, and longer service life of printers in low-temperature, high-humidity environments.

A characteristic feature of the present invention is that toner particle cracking and breakage and back-end offset can both be thoroughly suppressed in systems in which greater loads are applied to the toner, such as cleanerless systems, even in low-temperature, high-humidity environments. As a result, back-end offset is not produced at lower temperatures and a fogging-free image can also be obtained.

A preferred method for producing the toner according to the present invention is described in the following.

There are no particular limitations on the toner production method, and a known method can be adopted. In order to have the mechanical strength of the toner coexist with control of the state of surface melting, the toner preferably contains inorganic fine particles and an external addition step for the inorganic fine particles and a heating step in or after this external addition step are preferably present. The heating temperature $T_R$ in the heating step preferably satisfies the following relationship (1) with the glass transition temperature (Tg) of the toner particle. More preferably the following relationship (2) is satisfied.

$$Tg-10^\circ\text{ C.} \leq T_R \leq Tg+5^\circ\text{ C.} \quad (1)$$

$$Tg-5^\circ\text{ C.} \leq T_R \leq Tg+5^\circ\text{ C.} \quad (2)$$

The following, for example, are effective for increasing the mechanical strength of toner: increasing the molecular weight of the toner, and/or imparting rigidity to the molecular structure by crosslinking. However, when the molecular weight and/or crosslinking density is increased too much, the fixing characteristics, e.g., the back-end offset and so forth, assume a declining trend. In order to increase the mechanical strength of toner, a heating step is preferably disposed in or after the external addition step, while keeping the molecular weight and/or crosslink density at or below a certain level. The mechanical strength of the toner can be substantially increased by doing this. The reason is as follows.

The external addition step, in which the inorganic fine particles are attached to the toner particle surface, generally uses strong impact forces resulting in the accumulation of residual stress in the toner interior. During investigations by the present inventors, it was found that this accumulation of residual stress is substantial, that is, as longer times and stronger impact are required in the external addition step, the occurrence of toner particle cracking induced by stress in the cartridge is increasingly facilitated.

Moreover, it was found that this residual stress could be effectively relaxed by bringing about stabilization by eliminating the molecular chain strain produced in the binder resin by the external addition step. An effective means for eliminating this molecular chain strain is a step of heating to the vicinity of the glass transition temperature Tg, where the molecular chains undergo motion, to be implemented in or after the external addition step (to be implemented during the external addition step or after the external addition step). The condition Tg−10° C.≤$T_R$≤Tg+5° C. is preferred for the temperature $T_R$ in the heating step, while Tg−5° C.≤$T_R$≤Tg+5° C. is more preferred. The heating time is not particularly limited, but is preferably from 3 minutes to 30 minutes and is more preferably from 3 minutes to 10 minutes. Viewed from the standpoint of the storability, the glass transition temperature Tg of the toner particle is preferably from 40° C. to 70° C. and is more preferably from 50° C. to 65° C.

When a release agent is used in the toner, release agent present in the toner particle interior transfers to the vicinity of the toner particle surface at the same time as the heating step, and as a consequence melting in the vicinity of the toner particle surface is further promoted and control of the Tε is made even easier. The condition Tg−10° C.≤$T_R$≤Tg+5° C. is also preferred for this effect, because this condition has effects with regard to molecular chain motion and promotion of release agent transfer.

Another effect is that the fixing of the inorganic fine particles present on the toner particle surface is facilitated by the heating; migration of the inorganic fine particles to the charging member is thereby suppressed and maintenance of the desired charging characteristics by the electrostatic latent image bearing member is facilitated. The fixing ratio for the inorganic fine particles here is preferably from 80% to 100%.

Figure 3:
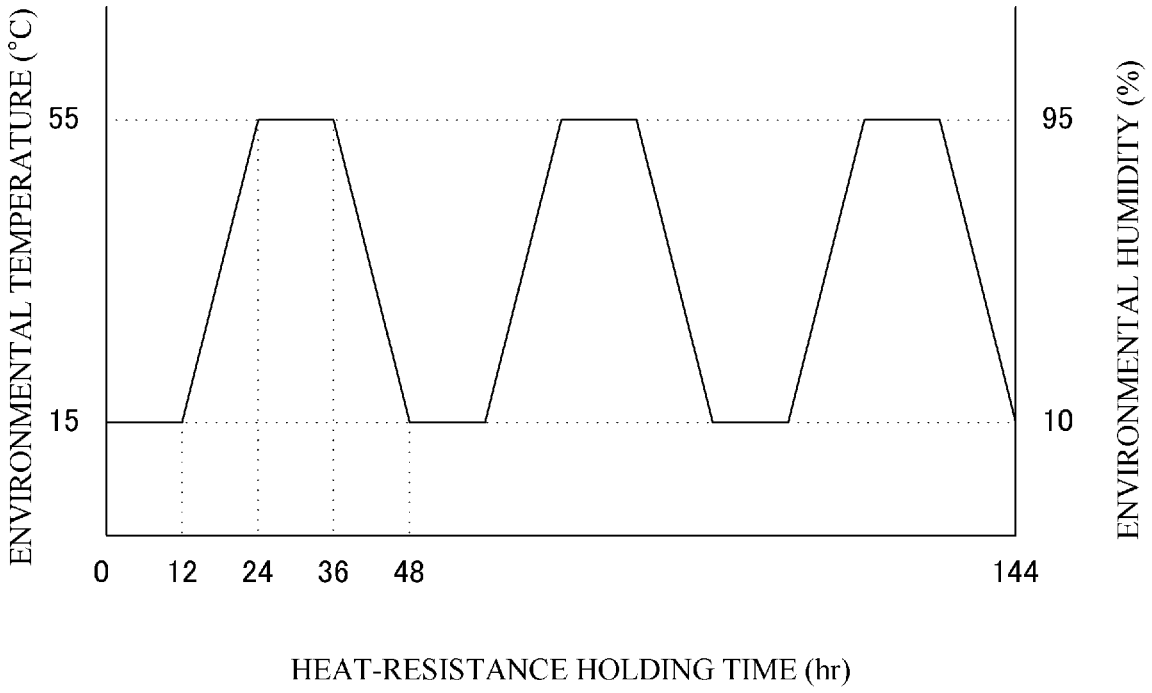
FIG. 3 is a schematic diagram that shows a heat cycling time chart.

In addition, by going through this heating step, back-end offset could be inhibited while the storability was improved even for environments involving exposure to heat cycling as shown in FIG. 3, which is presumed for extended transport. The reason for this is unclear, but the following is hypothesized.

When a step of heating in the vicinity of the Tg of the toner particle is carried out, the relaxation enthalpy undergoes a substantial decline and the arrangement of the binder resin molecular chains in the toner particle is stabilized and an equilibrium state is assumed. At the same time, crystalline material, e.g., the release agent, migrates to the vicinity of the surface. Due to the simultaneous occurrence of this release agent migration and stabilization of molecular chain arrangement, the crystalline material can migrate to the vicinity of the surface while the exudation of, e.g., the release agent, to the toner particle surface is suppressed. The present inventors hypothesize that these events are related to achieving both a high level of storability and a strong promotion of melting in the vicinity of the toner particle surface.

The relaxation enthalpy of the toner is preferably not more than 2.5 J/g in order for a high level of storability to coexist as indicated above with a strong promotion of melting in the vicinity of the toner particle surface. Not more than 2.0 J/g is more preferred. While there is no particular limitation on the lower limit, at least 0.1 J/g is preferred. The procedure for measuring the relaxation enthalpy is described below.

In addition, by controlling this relaxation enthalpy into the indicated range and having the fixing ratio for the inorganic fine particles (preferably silica) on the toner particle surface be from 80% to 100%, stabilization of the molecular chains in the binder resin is combined with the absence of detachment and migration by the inorganic fine particles on the toner particle surface and a favorable charge distribution is maintained during long-term use. As a result, the development ghosts caused by overcharging of the toner during long-run use can be suppressed.

An apparatus having a mixing functionality is preferred for the apparatus used in the heating step. A known mixing process apparatus may be used, but an apparatus as shown in FIG. 1 is particularly preferred from the standpoints of the efficiency of residual stress relaxation and the efficiency of fixing of the inorganic fine particles.

FIG. 1 is a schematic diagram that shows an example of a mixing process apparatus that can be used in the heating step.

Figure 2:
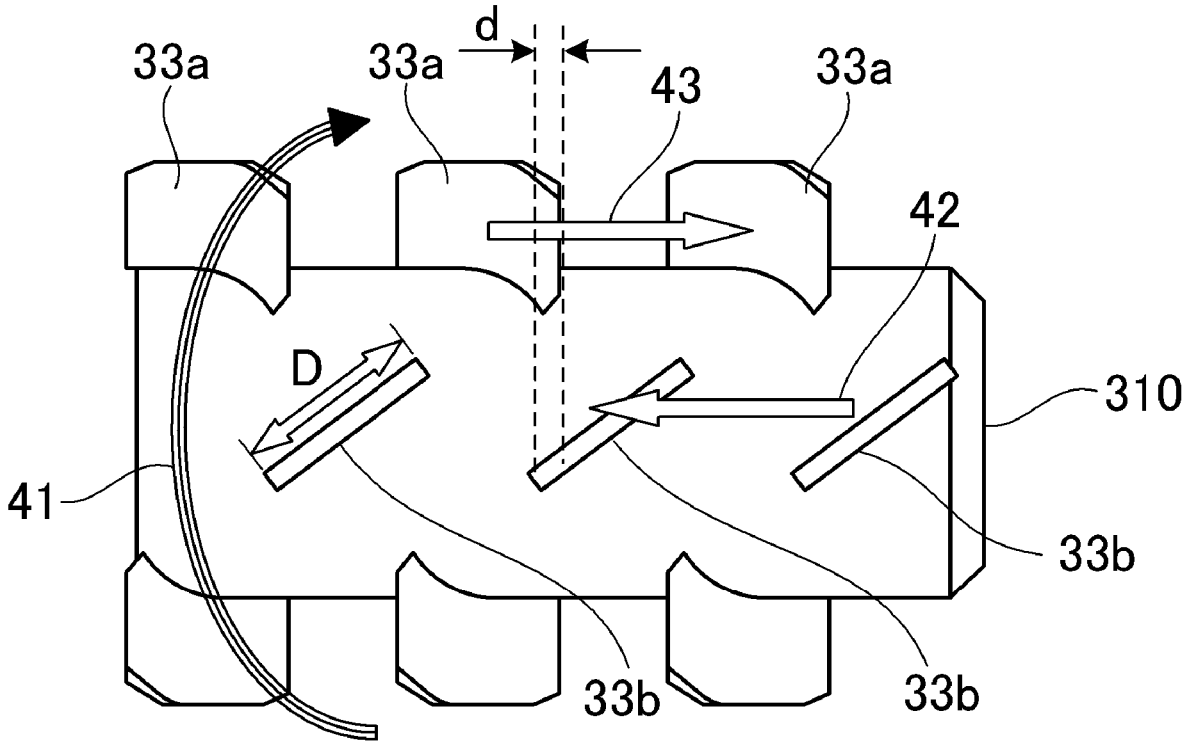
FIG. 2 is a schematic diagram that shows an example of the structure of the stirring member used in the mixing process apparatus.

FIG. 2, on the other hand, is a schematic diagram that shows an example of the structure of the stirring member used in the aforementioned mixing process apparatus. This mixing process apparatus has a rotating member 32, on the surface of which at least a plurality of stirring members 33 are disposed; a drive member 38, which drives the rotation of the rotating member; and a main casing 31, which is disposed to have a gap with the stirring members 33.

At the gap (clearance) between the inner circumference of the main casing 31 and the stirring member 33, heat is efficiently applied to the toner, in combination therewith a uniform shear is imparted to the toner, and the inorganic fine particles are attached to the toner particle surface while being broken up from secondary particles into primary particles.

Moreover, as described below, circulation of the starting materials in the axial direction of the rotating member is facilitated and a uniform and thorough mixing is facilitated prior to the progress of attachment.

The diameter of the inner circumference of the main casing 31 in this apparatus is not more than twice the diameter of the outer circumference of the rotating member 32. An example is shown in FIG. 1 in which the diameter of the inner circumference of the main casing 31 is 1.7-times the diameter of the outer circumference of the rotating member 32 (the trunk diameter provided by excluding the stirring members 33 from the rotating member 32). When the diameter of the inner circumference of the main casing 31 is not more than twice the diameter of the outer circumference of the rotating member 32, the inorganic fine particle taking the form of secondary particles is thoroughly dispersed since the processing space in which forces act on the toner particle is suitably limited.

In addition, it is important to adjust the aforementioned clearance in conformity to the size of the main casing. It is important from the standpoint of efficiently applying heat to the toner that the clearance is approximately from 1% to 5% of the diameter of the inner circumference of the main casing 31. Specifically, when the diameter of the inner circumference of the main casing 31 is approximately 130 mm, the clearance is preferably made approximately from 2 mm to 5 mm; when the diameter of the inner circumference of the main casing 31 is about 800 mm, the clearance is preferably made approximately from 10 mm to 30 mm.

As shown in FIG. 2, at least a portion of the plurality of stirring members 33 is formed as a forward transport stirring member 33*a* that, accompanying the rotation of the rotating member 32, transports the toner in one direction along the axial direction of the rotating member. In addition, at least a portion of the plurality of stirring members 33 is formed as a back transport stirring member 33*b* that, accompanying the rotation of the rotating member 32, returns the toner in the other direction along the axial direction of the rotating member. Here, when a starting material inlet port 35 and a product discharge port 36 are disposed at the two ends of the main casing 31, as in FIG. 1, the direction toward the product discharge port 36 from the starting material inlet port 35 (the direction to the right in FIG. 1) is the "forward direction".

That is, as shown in FIG. 2, the face of the forward transport stirring member 33*a* is tilted so as to transport the toner in the forward direction 43. On the other hand, the face of the back transport stirring member 33*b* is tilted so as to transport the toner in the back direction 42.

By means of the preceding, a heating process is carried out while repeatedly performing transport in the "forward direction" 43 and transport in the "back direction" 42. In addition, with regard to the stirring members 33*a* and 33*b*, a plurality of members disposed at intervals in the circumferential direction of the rotating member 32 form a set. In the example shown in FIG. 2, two members at an interval of 180° with each other form a set of the stirring members 33*a* and 33*b* on the rotating member 32, but a larger number of members may form a set, such as three at an interval of 120° or four at an interval of 90°.

In the example shown in FIG. 2, a total of twelve stirring members 33*a* and 33*b* are formed at an equal interval.

Furthermore, D in FIG. 2 indicates the width of a stirring member and d indicates the distance that represents the overlapping portion of a stirring member. In FIG. 2, D is preferably a width that is approximately from 20% to 30% of the length of the rotating member 32, when considered from the standpoint of bringing about an efficient transport of the toner in the forward direction and back direction. FIG. 2 shows an example in which D is 23%. Moreover, when an extension line is drawn in the perpendicular direction from the position of the end of the stirring member 33*a*, the stirring members 33*a* and 33*b* preferably have a certain overlapping portion d of the stirring member 33*a* with the stirring member 33*b*.

This makes it possible to efficiently disperse the inorganic fine particle on the toner particle surface. This d is preferably from 10% to 30% of D from the standpoint of the application of shear.

In addition to the shape shown in FIG. 2, the blade shape may be—insofar as the toner particles can be transported in the forward direction and back direction and the clearance is maintained—a shape having a curved surface or a paddle structure in which a distal blade element is connected to the rotating member 32 by a rod-shaped arm.

A more detailed explanation follows with reference to the schematic diagrams of the apparatus shown in FIGS. 1 and 2.

The apparatus shown in FIG. 1 has a rotating member 32, which has at least a plurality of stirring members 33 disposed on its surface; a drive member 38 that drives the rotation of the rotating member 32; and a main casing 31, which is disposed forming a gap with the stirring members 33. It also has a jacket 34, in which a heat transfer medium can flow and which resides on the inside of the main casing 31 and adjacent to the end surface 310 of the rotating member.

In addition, the apparatus shown in FIG. 1 has a starting material inlet port 35, which is formed on the upper side of the main casing 31, and has a product discharge port 36, which is formed on the lower side of the main casing 31. The starting material inlet port 35 is used to introduce the toner, and the product discharge port 36 is used to discharge, from the main casing 31 to the outside, the toner that has been subjected to the external addition and mixing process.

The apparatus shown in FIG. 1 also has a starting material inlet port inner piece 316 inserted in the starting material inlet port 35 and a product discharge port inner piece 317 inserted in the product discharge port 36.

The starting material inlet port inner piece 316 is first removed from the starting material inlet port 35; the toner is introduced into the processing space 39 from the starting material inlet port 35; and the starting material inlet port inner piece 316 is inserted. The rotating member 32 is subsequently rotated by the drive member 38 (41 indicates the direction of rotation), and the material to be processed, introduced as described above, is subjected to a heating and mixing process while being stirred and mixed by the plurality of stirring members 33 disposed on the surface of the rotating member 32.

Heating can be performed by passing hot water at the desired temperature into the jacket 34. The temperature is monitored by a thermocouple disposed in the interior of the starting material inlet port inner piece 316. In order to obtain the toner according to the present invention on a stable basis, the temperature T (thermocouple temperature) in the interior of the starting material inlet port inner piece 316 preferably satisfies the following relationship (3) with the glass transition temperature (Tg) of the toner particle. More preferably the following relationship (4) is satisfied.

$$Tg-10^\circ\ \text{C.} \leq T \leq Tg+5^\circ\ \text{C.} \quad (3)$$

$$Tg-5^\circ\ \text{C.} \leq T \leq Tg+5^\circ\ \text{C.} \quad (4)$$

With regard to the conditions for the heating and mixing process, the power of the drive member 38 is controlled preferably to from $1.0\times10^{-3}$ W/g to $1.0\times10^{-1}$ W/g and more preferably from $5.0\times10^{-3}$ W/g to $5.0\times10^{-2}$ W/g. In order to relax the internal stress in the toner and increase the mechanical strength of the toner, external energy is preferably not imparted to the toner to the greatest extent possible. On the other hand, in order to provide a uniform state of attachment and state of coverage for the inorganic fine particle, a minimum power is required, and control into the range indicated above is preferred.

The power of the drive member 38 is the value obtained by subtracting the empty power (W) during operation when the toner has not been introduced, from the power (W) when the toner has been introduced, and dividing by the amount (g) of toner introduced.

The processing time is not particularly limited since it also depends on the heating temperature, but is preferably from 3 minutes to 30 minutes and is more preferably from 3 minutes to 10 minutes. Control into this range facilitates the coexistence of the toner strength with immobilization.

The rotation rate of the stirring members is linked to the aforementioned power and operation and is thus not particularly limited. For the apparatus shown in FIG. 1 in which the volume of the processing space 39 of the apparatus is $2.0\times10^{-3}$ $m^3$, the rpm of the stirring members—when the shape of the stirring members 33 is as shown in FIG. 2—is preferably from 50 rpm to 500 rpm and is more preferably from 100 rpm to 300 rpm.

After the completion of the mixing process, the product discharge port inner piece 317 in the product discharge port 36 is removed and the toner is discharged from the product discharge port 36 by rotating the rotating member 32 with the drive member 38. As necessary, for example, coarse toner particles may be separated by sieving using, e.g., a circular vibrating sieve.

The heating step is preferably provided in toner production during or after the external addition step. Using the mixing process conditions described in the preceding, external addition and the heating process may be carried out at the same time, or the heating process may be performed using the aforementioned apparatus on toner for which the external addition step has been completed.

Heating is more preferably carried out using the aforementioned mixing process apparatus after performing mixing and external addition of the toner particle and inorganic fine particle using a known mixer such as a Henschel mixer.

The following are examples of the mixer for the external addition step: Henschel mixer (Nippon Coke & Engineering Co., Ltd.); Supermixer (Kawata Mfg. Co., Ltd.); Ribocone (Okawara Mfg. Co., Ltd.); Nauta mixer, Turbulizer, and Cyclomix (Hosokawa Micron Corporation); Spiral Pin Mixer (Pacific Machinery & Engineering Co., Ltd.); and Loedige Mixer (Matsubo Corporation).

The toner according to the present invention has the aforementioned characteristics, but is not otherwise limited; however, a constitution as given by the following is more preferred.

The value of the storage elastic modulus G' at Tε (° C.) in a dynamic viscoelastic measurement (ARES) of the toner is preferably from $2.0\times10^{7}$ Pa to $1.0\times10^{10}$ Pa. From $5.0\times10^{7}$ Pa to $1.0\times10^{9}$ Pa is more preferred.

In a dynamic viscoelastic measurement, the viscoelasticity is measured with the application of heat and pressure to the toner after it has been converted into a pellet by molding at 120° C. Accordingly, the state of the surface and interior of the toner particle has little influence and the viscoelasticity of the toner as a whole can be measured.

The suppression of back-end offset can readily coexist with the suppression of toner particle cracking and breakage when the value of the storage elastic modulus G' at Tε (° C.) is from $2.0\times10^{7}$ Pa to $1.0\times10^{10}$ Pa. This means that the central part of the toner particle retains its elasticity while melting is selectively promoted only in the vicinity of the toner particle surface. The value of the storage elastic modulus G' at Tε (° C.) can be controlled by adjusting the amount of THF-insoluble matter and by adjusting the type and amount of the release agent and/or amorphous polyester.

The binder resin contained in the toner according to the present invention preferably contains a vinyl resin. The presence of the vinyl resin, for example, facilitates maintenance of the rigidity and viscosity of the toner particle and facilitates suppression of toner particle cracking and breakage.

The toner particle also preferably contains an amorphous polyester resin. The presence of the amorphous polyester facilitates obtaining toner particles in which there are few irregularly shaped particles. By minimizing the irregularly shaped particles, the load applied to the toner can be dispersed, and as a consequence the suppression of cracking and chipping is facilitated. For example, when the toner particle is produced by a suspension polymerization method, the presence of the amorphous polyester resin is thought to enhance the dispersibility of the colorant in the polymerizable monomer composition in the granulation step and polymerization step and to stabilize the particles of the polymerizable monomer composition in the aqueous medium. This is thought to inhibit particle-to-particle coalescence and thereby yield toner particles having few irregularly shaped particles.

In addition, locations that melt in a particular temperature region can be introduced using the amorphous polyester resin, thereby facilitating the suppression of back-end offset.

In the toner particle cross section observed with a transmission electron microscope (TEM), preferably the vinyl resin forms a matrix and the amorphous polyester resin forms a plurality of domains.

Moreover, the percentage for these domains present in the region within 25%, from the contour of the toner particle cross section, of the distance between this contour and the centroid of the cross section, expressed with reference to the total area of these domains, is preferably from 30 area % to 70 area %.

When the area percentage for the amorphous polyester domains present within 25%, from the contour of the toner particle cross section, of the distance between this contour and the centroid of the cross section (also referred to below as the "25% area ratio") is at least 30 area %, this facilitates interaction with the release agent that migrates to the vicinity of the surface due to implementation of the heating step, further promoting surface melting and facilitating the suppression of back-end offset. At not more than 70 area %, the suppression of toner particle cracking and breakage is facilitated and burying of the external additive can also be inhibited, retention of the flowability is facilitated, and suppression of the development ghosts during long-run use is facilitated. The 25% area ratio is more preferably from 40 area % to 70 area % and is even more preferably from 50 area % to 70 area %.

The percentage for the amorphous polyester domains present in the region within 50%, from the contour of the toner particle cross section, of the distance between this contour and the centroid of the cross section is preferably from 80 area % to 100 area % with reference to the total area of the domains. From 90 area % to 100 area % is more preferred.

Instantaneous melting can occur during fixing, and as a consequence suppression of the back-end offset is facilitated, when the area percentage for the amorphous polyester domains present within 50%, from the contour of the toner particle cross section, of the distance between this contour and the centroid of the cross section (also referred to below as the "50% area ratio") is at least 80 area %.

The presence of these domains at 80 area % or more can be restated from a different perspective as not more than 20 area % of the domains occur in the region from the centroid of the toner particle cross section to 50% of the contour of the toner particle cross section. When such a state is present, the reduction of the melt viscosity in the toner particle interior can be restrained and suppression of toner particle cracking and breakage is facilitated, and this readily leads to a suppression of fogging.

The area of the amorphous polyester domains present within 25%, from the contour of the toner particle cross section, of the distance between this contour and the centroid of the cross section is preferably at least 1.05-times the area of the amorphous polyester domains present at from 25% to 50%, from the contour of the toner particle cross section, of the distance between the contour of the cross section and the centroid of the cross section. This indicates that the domains are more segregated to the toner particle surface. Instantaneous melting can occur during fixing by having the domains be more segregated to the toner particle surface, and the suppression of back-end offset is facilitated as a consequence.

The (area of the amorphous polyester domains present within 25% of the distance from the contour of the toner cross section to the centroid of the cross section/area of the amorphous polyester domains present at from 25% to 50% of the distance from the contour of the cross section to the centroid of the cross section (also referred to below as the domain area ratio)) is preferably at least 1.05 and is more preferably at least 1.20. While there is no particular limitation on the upper limit, it is preferably not more than 3.00.

The acid value Av of the amorphous polyester is preferably from 1.0 mg KOH/g to 10.0 mg KOH/g. From 4.0 mg KOH/g to 8.0 mg KOH/g is more preferred. This range is preferred because it facilitates controlling the 25% area ratio, the 50% area ratio, and the domain area ratio into the specified ranges.

The hydroxyl value OHv of the amorphous polyester is preferably not more than 40.0 mg KOH/g. For example, when the toner is obtained by the suspension polymerization method, having the hydroxyl value OHv of the amorphous polyester be not more than 40.0 mg KOH/g facilitates the formation by the amorphous polyester of a plurality of domains in the vicinity of the toner particle surface. As a result, control of the Tε is facilitated and suppression of the back-end offset is facilitated.

The amorphous polyester is preferably executed as a low softening point material from the standpoint of controlling the Tε. To achieve this, the amorphous polyester is preferably a polycondensate of an alcohol component and a carboxylic acid component that contains from 10 mol % to 50 mol % of a linear aliphatic dicarboxylic acid having from 6 to 12 carbons. By doing this, a reduction in the softening point of the amorphous polyester is readily brought about in a state in which the amorphous polyester has been provided with a high molecular weight, and as a consequence control of the Ts is facilitated while toner particle cracking and breakage are restrained. In addition, there is an increase in the affinity with the release agent that migrates to the vicinity of the surface due to execution of the heating step, and surface melting can thus be promoted still further.

In addition, the amorphous polyester can undergo instantaneous melting during fixing due to the presence of a monomer unit derived from linear aliphatic dicarboxylic acid having from 6 to 12 carbons. Due to this, the Ts is readily reduced and as a result the occurrence of toner particle-to-toner particle adhesion is facilitated and the suppression of back-end offset is facilitated. The present inventors hypothesize that this occurs because the linear aliphatic dicarboxylic acid segment undergoes folding and the amorphous polyester then forms a pseudo-crystalline structure.

When the number of carbons in the linear aliphatic dicarboxylic acid is at least 6, the linear aliphatic dicarboxylic acid segment can then readily undergo folding and the presence of the pseudo-crystalline structure is facilitated. Instantaneous melting during fixing is made possible as a result, and as a consequence the occurrence of toner particle-to-toner particle adhesion is facilitated. When the number of carbons in the linear aliphatic dicarboxylic acid is not more than 12, the softening point and molecular weight are then readily controllable and as a consequence control of the Tε is facilitated while a higher hardness for the toner particle is also readily achieved. From 6 to 10 is more preferred.

Bringing about a reduction in the softening point is readily achieved when the content of the linear aliphatic dicarboxylic acid (the content of the monomer unit derived from the linear aliphatic dicarboxylic acid) is at least 10 mol %, which is thus preferred. When the content of the linear aliphatic dicarboxylic acid is not more than 50 mol %, reductions in the molecular weight of the amorphous polyester are then suppressed and as a consequence toner particle cracking and breakage are readily suppressed. The content of the linear aliphatic dicarboxylic acid is preferably from 30 mol % to 50 mol %. Here, "monomer unit" refers to the reacted state of the monomer substance in the polymer.

The carboxylic acid component for producing the amorphous polyester can be exemplified by linear aliphatic dicarboxylic acid having from 6 to 12 carbons and by other carboxylic acids. The linear aliphatic dicarboxylic acid having from 6 to 12 carbons can be exemplified by adipic acid, suberic acid, sebacic acid, and 1,12-dodecanedioic acid. Examples of carboxylic acids other than linear aliphatic dicarboxylic acids having from 6 to 12 carbons are as follows.

The dibasic carboxylic acid component can be exemplified by maleic acid, fumaric acid, phthalic acid, isophthalic acid, terephthalic acid, succinic acid, glutaric acid, and n-dodecenylsuccinic acid and the anhydrides and lower alkyl esters of these acids.

The at least tribasic polybasic carboxylic acid component can be exemplified by 1,2,4-benzenetricarboxylic acid, 2,5,7-naphthalenetricarboxylic acid, pyromellitic acid, and Empol trimer acid and the anhydrides and lower alkyl esters of these acids. Among the preceding, terephthalic acid can maintain a high peak molecular weight and readily maintains the durability, and its use is thus preferred.

The alcohol component for obtaining the amorphous polyester can be exemplified by propylene oxide adducts on bisphenol A as well as by the following. The dihydric alcohol component can be exemplified by ethylene oxide adducts on bisphenol A, ethylene glycol, 1,3-propylene glycol, and neopentyl glycol. The at least trihydric alcohol component can be exemplified by sorbitol, pentaerythritol, and dipentaerythritol.

A single dihydric alcohol component may be used by itself or used in combination with a plurality of compounds, and a single at least trihydric polyhydric alcohol component may be used by itself or in combination with a plurality of compounds. Among the preceding, a bisphenol A-derived alcohol component such as the following formula (A) is preferably used for the alcohol component from the standpoint of the ease of control of the state of occurrence of the release agent described below.

(A)

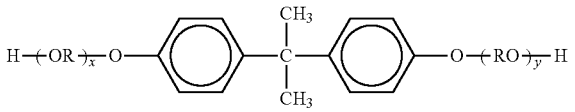

[In the formula, R is an ethylene or propylene group; x and y are each integers equal to or greater than 1; and the average value of x+y is 2 to 10.]

The amorphous polyester can be produced by an esterification reaction or transesterification reaction using the aforementioned alcohol component and carboxylic acid component. A known esterification catalyst and so forth may be used as appropriate during the polycondensation in order to accelerate the reaction.

The molar ratio between the carboxylic acid component and alcohol component (carboxylic acid component/alcohol component) that are the starting monomers for the amorphous polyester is preferably from 0.60 to 1.00.

The glass transition temperature (Tg) of the amorphous polyester is preferably from 45° C. to 75° C. from the standpoint of the fixing performance and heat-resistant storability.

The glass transition temperature (Tg) can be measured with a differential scanning calorimeter (DSC).

The amorphous polyester preferably has a weight-average molecular weight (Mw) from 8,000 to 20,000 and a softening point from 85° C. to 105° C.

An Mw of at least 8,000 facilitates suppression of toner particle cracking and breakage during long-term use. Heating-induced melting occurs instantaneously at not more than 20,000, and as a consequence control of the Tε is facilitated.

A softening point for the amorphous polyester of at least 85° C. facilitates suppression of toner particle cracking and breakage during long-run use. A softening point of not more than 105° C. supports the instantaneous occurrence of heat-induced melting and as a consequence facilitates control of the Tε.

In order to control the Mw and softening point of the amorphous polyester into the ranges indicated above, a unit derived from linear aliphatic dicarboxylic acid having from 6 to 12 carbons may be incorporated in the range indicated above.

The peak molecular weight Mp of the toner is preferably from 18,000 to 28,000. The softening point of the toner is preferably from 115° C. to 140° C. and is more preferably from 120° C. to 135° C. Having the softening point of the toner be in the indicated range facilitates the coexistence of suppression of back-end offset with suppression of the fogging due to toner particle cracking and breakage.

The present invention is described in additional detail in the following.

The binder resin used in the toner is exemplified by the following: vinyl resins, styrene resins, styrene copolymer resins, polyester resins, polyol resins, polyvinyl chloride resins, phenolic resins, natural resin-modified phenolic resins, natural resin-modified maleic acid resins, acrylic resins, methacrylic resins, polyvinyl acetate, silicone resins, polyurethane resins, polyamide resins, furan resins, epoxy resins, xylene resins, polyvinyl butyral, terpene resins, coumarone-indene resins, and petroleum resins. The following resins are preferably used from among the preceding: styrene copolymer resins, polyester resins, and hybrid resins provided by mixing a polyester resin with a vinyl resin or by partially reacting the two.

As has been previously indicated, the binder resin preferably contains a vinyl resin. In addition to the vinyl resin, the aforementioned known resins used as binder resins may be used insofar as the effects of the present invention are not impaired.

The following, for example, can be used for the vinyl resin:

the homopolymers of styrene and its substituted forms, e.g., polystyrene and polyvinyltoluene;

styrene copolymers, e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; and polymethyl methacrylate, polybutyl methacrylate, polyvinyl acetate, polyethylene, polypropylene, polyvinyl butyral, and polyacrylic acid resins. A single one of the preceding may be used by itself or a plurality of species may be used in combination. Among the preceding, styrene copolymers and specifically styrene-butyl acrylate copolymers are particularly preferred from the standpoint of ease of control of the developing characteristics and the fixing performance.

The content of the amorphous polyester is preferably from 5.0 mass parts to 30.0 mass parts per 100 mass parts of the binder resin. From 5.0 mass parts to 25.0 mass parts is more preferred. At at least 5.0 mass parts, there is an elevated interaction with the release agent that migrates due to the execution of the heating step and the suppression of back-end offset is further facilitated. On the other hand, at not more than 30.0 mass parts, hardening of the toner particle interior is facilitated and the suppression of toner particle cracking and breakage is then facilitated, and this readily leads to an improvement in fogging.

A lipophilic segment may be installed at the molecular chain terminal of the amorphous polyester. The presence of the lipophilic segment facilitates interaction with the vinyl resin, as a result of which control of the domain size is facilitated.

A compound having a lipophilic segment may be reacted with the molecular chain terminal of the amorphous polyester in order to incorporate a lipophilic segment in terminal position on the molecular chain.

Aliphatic monoalcohols having from 10 to 50 carbons and/or aliphatic monocarboxylic acids having from 11 to 51 carbons are preferred for the compound having a lipophilic segment. These compounds can be exemplified by dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), capric alcohol, lauryl alcohol, myristyl alcohol, cetanol, stearyl alcohol, arachidyl alcohol, behenyl alcohol, and lignoceryl alcohol.

The number-average particle diameter (D1) of the toner is preferably from 5.0 μm to 9.0 μm. When the number-average particle diameter (D1) is in the indicated range, an excellent flowability is obtained and uniform triboelectric charging by the control member is facilitated, as a consequence of which the production of fogging is suppressed.

The toner particle may optionally incorporate a charge control agent in order to improve the charging characteristics. While various charge control agents may be used, charge control agents that provide a fast charging speed and that can maintain a constant amount of charge on a stable basis are particularly preferred. When the toner is produced using a polymerization method as described below, a charge control agent that causes little inhibition of the polymerization and that does not effectively include material soluble in the aqueous medium is preferred. The charge control agent can be exemplified by metal compounds of aromatic carboxylic acids such as salicylic acid, alkylsalicylic acids, dialkylsalicylic acids, naphthoic acid, and dicarboxylic acids; metal salts and metal complexes of azo dyes and azo pigments; polymeric compounds that have a sulfonic acid or carboxylic acid group in side chain position; boron compounds; urea compounds; silicon compounds; and calixarene.

For the case of internal addition to the toner particle, the amount of use of these charge control agents is, per 100 mass parts of the binder resin, preferably from 0.1 mass parts to 10.0 mass parts and more preferably from 0.1 mass parts to 5.0 mass parts. For the case of external addition to the toner particle, the amount of use is, per 100 mass parts of the toner particle, preferably from 0.005 mass parts to 1.000 mass parts and more preferably from 0.010 mass parts to 0.300 mass parts.

A release agent may be incorporated in the toner particle in order to improve the fixability. The content of the release agent in the toner particle, per 100 mass parts of the binder resin, is preferably from 1.0 mass part to 30.0 mass parts and is more preferably from 3.0 mass parts to 25.0 mass parts.

When the release agent content is at least 1.0 mass part, and when a heating step as described above is used, the release agent is then readily controlled into a favorable state of occurrence, and this makes it easier to suppress back-end offset. At not more than 30.0 mass parts, toner deterioration during long-term use is readily suppressed.

The release agent can be exemplified by petroleum waxes such as paraffin wax, microcrystalline wax, and petrolatum and derivatives thereof; montan wax and derivatives thereof; hydrocarbon waxes produced by the Fischer-Tropsch method and derivatives thereof; polyolefin waxes such as polyethylene, and derivatives thereof; and natural waxes such as carnauba wax and candelilla wax, and derivatives thereof. The derivatives include oxides and block copolymers and graft modifications with vinyl monomer. The following can also be used as the release agent: higher aliphatic alcohols; fatty acids such as stearic acid and palmitic acid; acid amide waxes; ester waxes; hydrogenated castor oil and derivatives thereof; vegetable waxes; and animal waxes.

Among these release agents, the use is preferred of paraffin wax (hydrocarbon wax) from the standpoint of facilitating suppression of toner particle cracking and breakage. The release agent preferably contains paraffin wax and ester wax for the following reason: a high affinity with the amorphous polyester is then obtained, as a consequence of which surface melting can be substantially promoted by the execution of the heat step and control of the $T\varepsilon$ is facilitated.

The melting point of the release agent, as given by the maximum endothermic peak temperature during temperature ramp up in measurement with a differential scanning calorimeter (DSC), is preferably from 60° C. to 140° C. and is more preferably from 65° C. to 120° C. Toner deterioration during long-term use is readily suppressed when the melting point is at least 60° C. A reduction in the low-temperature fixability is suppressed when the melting point is not more than 140° C.

The melting point of the release agent is the peak top of the endothermic peak during measurement by DSC. In addition, measurement of the peak top of the endothermic peak is carried out in accordance with ASTM D 3417-99. The following, for example, can be used for this measurement: DSC-7 from PerkinElmer Inc., DSC2920 from TA Instruments, and Q1000 from TA Instruments. Temperature correction in the instrument detection section is performed using the melting points of indium and zinc, and the amount of heat is corrected using the heat of fusion of indium. The measurement is carried out using an aluminum pan for the measurement sample and installing an empty pan for reference.

The colorant is described in the following.

The black colorant is carbon black, a magnetic body, or a black colorant provided by coloring mixing the yellow/magenta/cyan colorants described below to give a black color.

A single-component developing system is another effective means for printer downsizing. Another effective means is to eliminate the feed roller that feeds the toner in the cartridge to the toner carrying member.

Such a single-component developing system lacking a feed roller is preferably a magnetic single-component developing system, wherein a magnetic toner that uses a magnetic body for the toner colorant is preferred. A high transportability and coloring performance are obtained by using such a magnetic toner.

When a suspension polymerization method is used for the toner production method, the use is preferred of a magnetic body that has been subjected to a hydrophobic treatment, wherein the hydrophobicity is preferably from 60.0% to 80.0%. Within this range, the magnetic bodies orient to the vicinity of the toner particle surface and provide strength against external stress.

The magnetic body is preferably a magnetic body in which the major component is a magnetic iron oxide such as triiron tetroxide or γ-iron oxide, and may contain an element such as phosphorus, cobalt, nickel, copper, magnesium, manganese, aluminum, or silicon. This magnetic body has a BET specific surface area by nitrogen adsorption of preferably 2 to 30 $m^2/g$ and more preferably 3 to 28 $m^2/g$. A magnetic body with a Mohs hardness of 5 to 7 is preferred. The shape of the magnetic body may be, for example, polyhedral, octahedral, hexahedral, spherical, acicular, flake, and so forth. However, low-anisotropy shapes, e.g., polyhedral, octahedral, hexahedral, and spherical, are preferred from the standpoint of increasing the image density.

The volume-average particle diameter of the magnetic body is preferably from 0.10 μm to 0.40 μm. When the volume-average particle diameter is at least 0.10 μm, magnetic body aggregation is inhibited and the uniformity of dispersion of the magnetic body in the toner is improved. The tinting strength of the toner is enhanced when the volume-average particle diameter is not more than 0.40 μm, and this is thus preferred.

The volume-average particle diameter of the magnetic body can be measured using a transmission electron microscope. Specifically, the toner particles to be observed are thoroughly dispersed in an epoxy resin, and a cured material is then obtained by curing for 2 days in an atmosphere with a temperature of 40° C. The obtained cured material is converted into a thin-section sample using a microtome, and, using a photograph at a magnification of 10,000× to 40,000× taken with a transmission electron microscope (TEM), the diameter of 100 magnetic bodies in the field of observation is measured. The volume-average particle diameter is determined based on the equivalent diameter of the circle equal to the projected area of the magnetic body. The particle diameter may also be measured using an image processing instrument.

The magnetic body can be produced, for example, by the following method. An alkali, e.g., sodium hydroxide, is added—in an equivalent amount or more than an equivalent amount with reference to the iron component—to an aqueous solution of a ferrous salt to prepare an aqueous solution containing ferrous hydroxide. Air is blown in while keeping the pH of the prepared aqueous solution at 7 or above, and an oxidation reaction is carried out on the ferrous hydroxide while heating the aqueous solution to at least 70° C. to first produce seed crystals that will form the core of the magnetic body.

Then, an aqueous solution containing ferrous sulfate is added, at approximately 1 equivalent based on the amount of addition of the previously added alkali, to the seed crystal-containing slurry. While maintaining the pH of the liquid at 5 to 10 and blowing in air, the reaction of the ferrous hydroxide is developed in order to grow magnetic iron oxide particles using the seed crystals as cores. At this point, the shape and magnetic properties of the magnetic body can be controlled by free selection of the pH, reaction temperature, and stirring conditions. The pH of the liquid transitions to the acidic side as the oxidation reaction progresses, but the pH of the liquid preferably does not drop below 5. The thusly obtained magnetic body is filtered, washed, and dried by standard methods to obtain the magnetic body.

As previously indicated, when the toner is produced by a suspension polymerization method, the execution of a hydrophobic treatment on the magnetic body surface is strongly preferred in order to facilitate encapsulation of the magnetic body in the toner. When the surface treatment is carried out by a dry method, treatment with a coupling agent can be carried out on the magnetic body that has been washed, filtered, and dried. When the surface treatment is carried out by a wet method, the coupling treatment can be carried out with redispersion of the material that has been dried after the completion of the oxidation reaction, or with redispersion, in a separate aqueous medium without drying, of the iron oxide obtained by washing and filtration after completion of the oxidation reaction. Specifically, a silane coupling agent is added while thoroughly stirring the redispersion and a coupling treatment is carried out by raising the temperature after hydrolysis or by adjusting the pH of the dispersion after hydrolysis into the alkaline region. Among the alternatives, from the standpoint of carrying out a uniform surface treatment, the surface treatment preferably is carried out by directly reslurrying after completion of the oxidation reaction, filtration, and washing, but without drying.

To perform the surface treatment of the magnetic body by a wet method, i.e., in order to treat the magnetic body with a coupling agent in an aqueous medium, the magnetic body is first thoroughly dispersed in an aqueous medium so as to convert it to the primary particle diameter and is stirred with, for example, a stirring blade, to prevent sedimentation and aggregation. A freely selected amount of coupling agent is then introduced into this dispersion and the surface treatment is performed while hydrolyzing the coupling agent. Also at this time, the surface treatment is more preferably carried out while stirring and while using a device such as a pin mill or line mill in order to bring about a thorough dispersion so as to avoid aggregation.

The aqueous medium here is a medium for which water is the major component. This can be specifically exemplified by water itself, water to which a small amount of a surfactant has been added, water to which a pH modifier has been added, and water to which an organic solvent has been added. The surfactant is preferably a nonionic surfactant, e.g., polyvinyl alcohol. The surfactant is preferably added at 0.1 to 5.0 mass parts per 100 mass parts of the water. The pH modifier can be exemplified by inorganic acids such as hydrochloric acid. The organic solvent can be exemplified by alcohols.

The coupling agents that can be used for the surface treatment of the magnetic body can be exemplified by silane compounds, silane coupling agents, titanium coupling agents, and so forth. A silane compound or silane coupling agent is more preferably used and is represented by general formula (1).

$$R_mSiY_n \qquad \text{general formula (1)}$$

[In the formula, R represents an alkoxy group (preferably having 1 to 3 carbons); m represents an integer from 1 to 3; Y represents a functional group such as an alkyl group (preferably having 2 to 20 carbons), phenyl group, vinyl group, epoxy group, (meth)acryl group, and so forth; and n represents an integer from 1 to 3; with the proviso that m+n=4.]

The silane compounds and silane coupling agents given by general formula (1) can be exemplified by vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane.

Among the preceding, the use of an alkyltrialkoxysilane represented by the following general formula (2) is preferred from the standpoint of imparting a high hydrophobicity to the magnetic body.

$$C_pH_{2p+1}\text{—}Si\text{—}(OC_qH_{2q+1})_3 \qquad (2)$$

[In the formula, p represents an integer from 2 to 20 (more preferably from 3 to 15) and q represents an integer from 1 to 3 (more preferably 1 or 2).]

A satisfactory hydrophobicity is readily imparted to the magnetic body when p in the aforementioned formula is at least 2. When p is not more than 20, the hydrophobicity is satisfactory while magnetic body-to-magnetic body coalescence can also be inhibited. The reactivity of the silane coupling agent is excellent when q is not more than 3 and a satisfactory hydrophobing is then obtained.

In the case of use of a silane coupling agent as described above, treatment may be carried out with a single one or may be carried out using a plurality in combination. When the combination of a plurality is used, a separate treatment may be performed with each individual coupling agent or a simultaneous treatment may be carried out.

Another colorant in addition to the magnetic body may be used in combination in the present invention. The co-usable colorant can be exemplified by known dyes and pigments and by magnetic inorganic compounds and nonmagnetic inorganic compounds. Specific examples are strongly magnetic metal particles, e.g., of cobalt or nickel; alloys provided by the addition thereto of, e.g., chromium, manganese, copper, zinc, aluminum, or a rare-earth element; particles of, e.g., hematite; titanium black; nigrosine dyes/pigments; carbon black; and phthalocyanines. These are also preferably used after surface treatment.

The content of the magnetic body in the toner particle, per 100 mass parts of the binder resin or the polymerizable monomer that produces the binder resin, is preferably 20 to 200 mass parts and more preferably 40 to 150 mass parts.

The yellow colorant can be exemplified by compounds as typified by condensed azo compounds, isoindolinone compounds, anthraquinone compounds, azo metal complexes, methine compounds, and arylamide compounds. Specific examples are C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

The magenta colorant can be exemplified by condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples are C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, and 269 and C. I. Pigment Violet 19.

The cyan colorant can be exemplified by copper phthalocyanine compounds and their derivatives, anthraquinone compounds, and basic dye lake compounds. Specific examples are C. I. Pigment Blue 1, 7, 15, 15:1, 15:2, 15:3, 15:4, 60, 62, and 66.

A single one of these colorants may be used or a mixture may be used, and these colorants may also be used in a solid solution state. The colorant is selected considering the hue angle, chroma, lightness, lightfastness, OHP transparency, and dispersibility in the toner. The amount of colorant addition is preferably 1 to 20 mass parts per 100 mass parts of the binder resin or polymerizable monomer that produces the binder resin.

When the toner particle is to be produced by a pulverization method, the toner components, e.g., the binder resin, colorant, and so forth, and optionally the release agent and other additives are thoroughly mixed using a mixer such as a Henschel mixer or ball mill. This is followed by melt-kneading using a hot kneader, e.g., a hot roll, kneader, or extruder, to bring about dispersion or dissolution of these materials, followed by cooling and solidification, pulverization, and then classification. A toner particle having a circularity of at least 0.960 can be obtained by additionally performing a surface modification. Either classification or surface modification may come before the other in the sequence. A multi-grade classifier is preferably used in the classification step based on a consideration of the production efficiency.

Control of the state of dispersion of the amorphous polyester resin can be achieved in pulverization methods by a process such as, for example, external addition of the amorphous polyester resin. The toner particle is preferably produced in the present invention in an aqueous medium, e.g., by a dispersion polymerization method, an association aggregation method, a dissolution suspension method, or a suspension polymerization method, whereamong the suspension polymerization method is more preferred. The coexistence of the suppression of back-end offset with the suppression of toner particle cracking and breakage is readily brought about by adopting these production methods.

In the suspension polymerization method, a polymerizable monomer composition is obtained by dissolving or dispersing colorant and polymerizable monomer that produces the binder resin (and optionally amorphous polyester resin, release agent, polymerization initiator, crosslinking agent, charge control agent, and other additives). This polymerizable monomer composition is then added to a continuous phase (for example, an aqueous medium (which may optionally contain a dispersion stabilizer)). Particles of the polymerizable monomer composition are formed in the continuous phase (in the aqueous medium), and the polymerizable monomer present in these particles is polymerized. A toner particle is obtained by proceeding according to this method. The shape of the individual toner particles in toner provided by the suspension polymerization method (also referred to below as "polymerized toner") is uniformly approximately spherical, and due to this an enhanced flowability in the control section and uniform triboelectric charging are facilitated. The suppression of fogging and an enhanced image quality are facilitated as a result.

Examples of the polymerizable monomer used in the production of polymerized toner are provided in the following.

The polymerizable monomer can be exemplified by styrene monomers such as styrene, o-methylstyrene, m-methylstyrene, p-methylstyrene, p-methoxystyrene, and p-ethyl styrene;

acrylate esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; and methacrylate esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate.

Other examples are acrylonitrile, methacrylonitrile, and acrylamide. A single one of these monomers may be used by itself or a mixture of these monomers may be used.

The binder resin preferably contains a vinyl resin. Due to this, among the polymerizable monomers given above, the use of styrene or a styrene derivative, individually or in a combination of a plurality of species, is preferred from the standpoint of the developing characteristics and durability of the toner. The use of styrene, and acrylate ester and/or methacrylate ester is more preferred.

A polar resin is preferably incorporated in the polymerizable monomer composition. Since the toner particle is produced in an aqueous medium in the suspension polymerization method, through the incorporation of a polar resin, a layer of the polar resin can be induced to form at the toner particle surface, and an enhanced charging performance is then facilitated, as is the suppression of post-black fogging.

The polar resin can be exemplified by homopolymers of styrene and its substituted forms, e.g., polystyrene and polyvinyltoluene;

styrene copolymers, e.g., styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleate ester copolymer; and polymethyl methacrylate, polybutyl methacrylate, polyvinyl acetate, polyethylene, polypropylene, polyvinyl butyral, silicone resins, polyamide resins, epoxy resins, polyacrylic acid resins, terpene resins, and phenolic resins. A single one of the preceding may be used by itself or a combination of a plurality of species may be used. A functional group, e.g., the amino group, carboxy group, hydroxyl group, sulfonic acid group, glycidyl group, nitrile group, and so forth, may be introduced into these polymers.

The polymerization initiator used in toner production by a polymerization method preferably has a half-life in the polymerization reaction of from 0.5 hours to 30.0 hours. In addition, the desired strength as well as suitable melting characteristics can be imparted to the toner when the polymerization reaction is run using from 0.5 mass parts to 20.0 mass parts for the amount of addition per 100 mass parts of the polymerizable monomer.

The specific polymerization initiator can be exemplified by the following: azo and diazo polymerization initiators such as 2,2'-azobis(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide-type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butyl peroxy-2-ethylhexanoate, and t-butyl peroxypivalate.

A crosslinking agent may be added to toner production by a polymerization method, and the preferred amount of addition is from 0.01 mass parts to 5.00 mass parts per 100 mass parts of the polymerizable monomer.

A compound having two or more polymerizable double bonds is mainly used as this crosslinking agent. For example, a single one of the following or a mixture of two or more of the following may be used:

an aromatic divinyl compound such as divinylbenzene, divinylnaphthalene, and so forth;

carboxylate esters having two double bonds, e.g., ethylene glycol diacrylate, ethylene glycol dimethacrylate, and 1,3-butanediol dimethacrylate;

divinyl compounds such as divinylaniline, divinyl ether, divinyl sulfide, and divinyl sulfone; and compounds having three or more vinyl groups.

When the toner is to be produced by a polymerization method, preferably the toner components and so forth as described above are combined and are dissolved or dispersed to uniformity using a disperser to obtain a polymerizable monomer composition. The disperser can be exemplified by homogenizers, ball mills, and ultrasound dispersers. The obtained polymerizable monomer composition is suspended in an aqueous medium that contains a dispersion stabilizer. At this point, a sharper particle diameter for the obtained toner particle is provided by generating, in no time, the desired toner particle size through the use of a high-speed disperser such as a high-speed stirrer or ultrasound disperser. With regard to the time point for the addition of the polymerization initiator, it may be added at the same time as the addition of other additives to the polymerizable monomer or it may be admixed immediately prior to suspension in the aqueous medium. The polymerization initiator may also be added immediately after granulation and prior to the initiation of the polymerization reaction.

After granulation, stirring should be carried out, using an ordinary stirrer, to a degree that maintains the particulate state and prevents flotation and sedimentation of the particles.

Various surfactants, organic dispersing agents, and inorganic dispersing agents can be used as a dispersion stabilizer during toner production. The use of inorganic dispersing agents is preferred among the preceding because they resist the production of toxic fines and provide a dispersion stabilizing action through steric hindrance. Such inorganic dispersing agents can be exemplified by the multivalent metal salts of phosphoric acid, e.g., tricalcium phosphate, magnesium phosphate, aluminum phosphate, zinc phosphate, and hydroxyapatite; metal salts such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

These inorganic dispersing agents are preferably used at from 0.2 mass parts to 20.0 mass parts per 100 mass parts of the polymerizable monomer. A single one of these dispersion stabilizers may be used by itself or a plurality may be used in combination. A surfactant may be used in combination therewith.

The polymerization temperature in the step of polymerizing the polymerizable monomer is set generally to at least 40° C. and preferably to a temperature from 50° C. to 90° C. When the polymerization is carried out in this temperature range, the release agent, which should be sealed in the interior, is precipitated through phase separation and is more completely encapsulated.

The obtained polymer particles are filtered, washed, and dried to obtain toner particles.

The toner can be obtained using an external addition step in which the inorganic fine particles as described below are as necessary mixed into the obtained toner particles to attach the inorganic fine particles to the toner particle surface. In addition, the coarse powder and fines present in the toner particles may also be cut by inserting a classification step in the production sequence (prior to mixing with the inorganic fine particles).

The toner preferably incorporates inorganic fine particles. Inorganic fine particles having a number-average primary particle diameter of preferably from 4 nm to less than 80 nm and more preferably from 6 nm to 40 nm are preferably added (externally added) to the toner particle as a fluidizing agent. In addition, inorganic fine particles having a number-average primary particle diameter of from 80 nm to 200 nm are more preferably used in combination therewith. By doing this, the flowability of the toner can be maintained during long-run use, a uniform and stable triboelectric charging performance is obtained, and the suppression of fogging and electrostatic offset is facilitated. The inorganic fine particles are added in order to improve toner flowability and provide uniform toner particle charging; however, in a preferred embodiment, functionalities such as, e.g., adjustment of the amount of toner charge, enhancement of the environmental stability, and so forth, are provided by subjecting the inorganic fine particles to a treatment, for example, a hydrophobic treatment.

The number-average primary particle diameter of the inorganic fine particles can be measured using an enlarged image of the toner taken using a scanning electron microscope.

Fine particles of, for example, silica, titanium oxide, and alumina can be used for the inorganic fine particles. The silica fine particles can be exemplified by the dry silica produced by the vapor-phase oxidation of a silicon halide or known as fumed silica, and by the wet silica produced from, for example, water glass.

However, dry silica is preferred because it has fewer silanol groups on the surface or in the interior of the silica and because it has little production residues, e.g., $Na_2O$, $SO_3^{2-}$, and so forth. In addition, a composite fine particle of silica and another metal oxide can also be obtained by using the silicon halide compound in combination with, for example, another metal halide compound, e.g., aluminum chloride, titanium chloride, and so forth, in the production process, and such composite fine particles are also encompassed by dry silica.

The amount of addition of the inorganic fine particles is preferably from 0.1 to 3.0 mass parts per 100 mass parts of the toner particle. The content of the inorganic fine particles can be determined using x-ray fluorescence analysis and using a calibration curve constructed from standard samples.

The inorganic fine particles are preferably subjected to a hydrophobic treatment because this can bring about an improved environmental stability for the toner. The treatment agent used for the hydrophobic treatment of the inorganic fine particles can be exemplified by silicone varnish, variously modified silicone varnishes, silicone oil, variously modified silicone oils, silane compounds, and silane coupling agents. The treatment agent can also be exemplified by other organosilicon compounds and by organotitanium compounds. A single one of these may be used by itself or a combination of a plurality may be used.

Among the treatment agents indicated above, treatment with a silicone oil is preferred, while more preferably treatment with a silicone oil is carried out at the same time as or after the execution of a hydrophobic treatment on the inorganic fine particles with a silane compound. Such a method for treating the inorganic fine particles can be exemplified by the execution, in a first-stage reaction, of a silylation reaction with a silane compound in order to extinguish the silanol group by chemical bonding, followed by the formation, in a second-stage reaction, of a hydrophobic thin film on the surface using a silicone oil.

This silicone oil has a viscosity at 25° C. of preferably from 10 $mm^2/s$ to 200,000 $mm^2/s$ and more preferably from 3,000 $mm^2/s$ to 80,000 $mm^2/s$.

For example, dimethylsilicone oil, methylphenylsilicone oil, α-methylstyrene-modified silicone oil, chlorophenylsilicone oil, and fluorine-modified silicone are particularly preferred for the silicone oil that is used.

The following are examples of methods for treating the inorganic fine particles with silicone oil: methods in which the inorganic fine particles, which have already been treated with a silane compound, are directly mixed with the silicone oil using a mixer such as a Henschel mixer, and methods in which the silicone oil is sprayed on the inorganic fine particles. Or, in another method, the silicone oil is dissolved or dispersed in a suitable solvent; the inorganic fine particles are then added with mixing; and the solvent is removed. Spraying methods are more preferred because they cause relatively little production of aggregates of the inorganic fine particles.

The amount of treatment with the silicone oil, per 100 mass parts of the inorganic fine particles, is preferably 1 to 40 mass parts and more preferably 3 to 35 mass parts. An excellent hydrophobicity is obtained in this range.

In order to impart an excellent flowability to the toner, the inorganic fine particles used in the present invention have a specific surface area, as measured by the BET method using nitrogen adsorption, preferably in the range of 20 to 350 $m^2/g$ and more preferably 25 to 300 $m^2/g$. The specific surface area can be determined according to the BET method using the BET multipoint procedure by adsorbing nitrogen gas to the sample surface using a "Gemini 2375 Ver. 5.0" specific surface area analyzer (Shimadzu Corporation).

Other additives that may also be used in small amounts in the toner of the present invention as developing performance improving agents can be exemplified by lubricant particles, e.g., fluororesin particles, zinc stearate particles, and polyvinylidene fluoride particles; abrasives, e.g., cerium oxide particles, silicon carbide particles, and strontium titanate particles; flowability-imparting agents, e.g., titanium oxide particles and aluminum oxide particles; anticaking agents; and opposite-polarity organic fine particles and inorganic fine particles. These additives may also be used after a hydrophobic treatment of the surface.

The methods used to measure the various properties involved with the present invention are described in the following.

Method for Measuring the Powder Dynamic Viscoelasticity of the Toner

The measurement is carried out using a DMA 8000 (PerkinElmer Inc.) dynamic viscoelastic analyzer.

Measurement tool: Material Pocket (P/N: N533-0322)

The toner (80 mg for magnetic toner, 50 mg for nonmagnetic toner) is sandwiched in a Material Pocket, which is installed in the single cantilever and fixed in place by tightening the bolts with a torque wrench.

The measurement uses the "DMA Control Software" (PerkinElmer Inc.) installed in the instrument. The measurement conditions are given below. The onset temperature Tε (° C.) is determined from the curve for the storage elastic modulus E' yielded by this measurement. Ts is the temperature at the intersection between the straight line that extends the baseline on the low temperature side of the E' curve to the high temperature side, and the tangent line drawn at the point where the gradient of the E' curve is a maximum.

Oven: Standard Air Oven
Measurement type: temperature scan
DMA condition: single frequency/strain (G)
Frequency: 1 Hz
Strain: 0.05 mm
Starting temperature: 25° C.
End temperature: 180° C.
Scan speed: 20° C./minute
Deformation mode: single cantilever (B)
Cross section: rectangle (R)
Test specimen size (length): 17.5 mm
Test specimen size (width): 7.5 mm
Test specimen size (thickness): 1.5 mm Method for Measuring the Dynamic Viscoelasticity of the Toner The measurements are carried out using an ARES dynamic viscoelastic measurement instrument (rheometer) (Rheometrics Scientific Inc.).

Measurement tool: serrated parallel plates, diameter 7.9 mm

Measurement sample: A cylindrical sample of the toner (approximately 1.2 g for magnetic toner, approximately 1.0 g for nonmagnetic toner) with a diameter of approximately 8 mm and a height of approximately 2 mm is molded using a press molder (15 kN maintained for 1 minute at normal temperature). An NT-100H 100 kN press from NPa System Co., Ltd. is used as the press molder.

While controlling the temperature of the serrated parallel plates to 120° C., the cylindrical sample is heated and melted and the serration is engaged and a perpendicular load is applied such that the axial force does not exceed 30 (gf) (0.294 N), thereby fixing into the serrated parallel plates. When this is done, a steel belt may be used in order to make the diameter of the sample the same as the diameter of the parallel plates. The serrated parallel plates and cylindrical sample are gradually cooled over 1 hour to the measurement start temperature of 30.00° C.

Measurement frequency: 6.28 radian/second

Measurement strain setting: The starting value is set to 0.1% and measurement is carried out in automatic measurement mode.

Sample expansion correction: Adjusted by the automatic measurement mode.

Measurement temperature: The temperature is raised at a rate of 2° C./minute from 30° C. to 150° C.

Measurement interval: The viscoelastic data is measured every 30 seconds, i.e., every 1° C.

The storage elastic modulus G' at Tε (° C.) is obtained from the storage elastic modulus curve yielded by this measurement.

Method for Measuring the Toner Strength by Nanoindentation

The toner strength is measured by nanoindentation using a Picodenter HM500 from Fischer Instruments K.K. WIN-HCU is used for the software. A Vickers indenter (angle: 130°) is used for the indenter.

Figure 5:
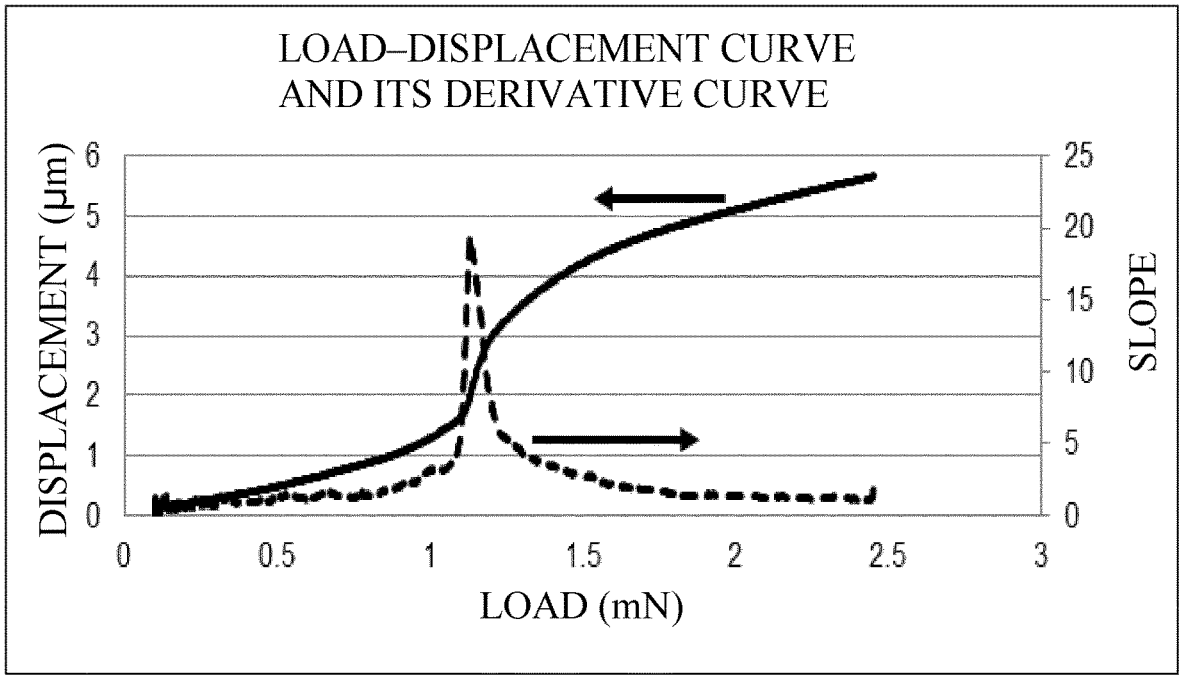
FIG. 5 is an example of a load-displacement curve obtained by a nanoindentation procedure and the differential curve provided by the differentiation of this curve by load.

The measurement consists of a step of pressing this indenter at a prescribed rate until a prescribed load is reached (referred to as the "indentation step" in the following). The toner strength is determined from the differential curve obtained by the differentiation, by load, of the load-displacement curve provided by this indentation step as shown in FIG. 5.

The microscope is first focused with the video camera screen connected to the microscope and displayed with the software. The target for focusing is the glass plate (hardness=3,600 N/mm$^2$) used for the Z-axis alignment described below. At this time, the objective lenses are focused in sequence from 5× to 20× and 50×. Subsequent to this, adjustment is carried out using the 50× objective lens.

The "approach parameter setting" process is then carried out using the aforementioned glass plate used for focusing as described above and the Z-axis alignment of the indenter is carried out. The glass plate is then replaced with an acrylic plate and the "indenter cleaning" process is carried out. This "indenter cleaning" process is a process in which the tip of the indenter is cleaned with a cotton swab moistened with ethanol and at the same time the indenter position specified by the software is brought into agreement with the indenter position on the hardware, i.e., XY-axis alignment of the indenter is performed.

Changeover to the toner-loaded microscope slide is then performed and the microscope is focused on the toner, which is the measurement target. The toner is loaded on the microscope slide using the following procedure.

First, the toner that is the measurement target is taken up by the tip of a cotton swab and the excess toner is sifted out at, for example, the edge of a bottle. The shaft of the cotton swab is then pressed against the edge of the microscope slide and the toner attached to the cotton swab is tapped off so as to form a single layer of the toner on the microscope slide.

The microscope slide bearing the toner single layer as described above is placed in the microscope; the toner is brought into focus with the 50× objective lens; and the tip of the indenter is positioned with the software so as to hit the center of a toner particle. The selected toner particles are limited to particles for which both the major diameter and minor diameter are approximately the D4 (μm) of the toner±1.0 μm.

The measurement is performed by carrying out the indentation step under the following conditions.

Indentation Step

Maximum indentation load=2.5 mN

Indentation time=100 seconds

A load-displacement curve is constructed by this measurement using the load (mN) for the horizontal axis and the displacement (μm) for the vertical axis.

The procedure for determining "the load that provides the largest slope", which is defined as the toner strength in the present invention, is to use the load at which the value of the derivative assumes the maximum value in the differential curve provided by differentiating the load-displacement curve by load. Considering the accuracy of the data, the load range from 0.20 mN to 2.30 mN is used to determine the differential curve.

This measurement is performed on 30 toner particles and the arithmetic average value is used.

In this measurement, the aforementioned "indenter cleaning" process (also including XY-axis alignment of the indenter) is always performed on each single particle measured.

Measurement of the Tg of the Toner Particle

The Tg of the toner particle is measured based on ASTM D 3418-82 using a "Q2000" differential scanning calorimeter (TA Instruments). Temperature correction in the instrument detection section is performed using the melting points of indium and zinc, and the amount of heat is corrected using the heat of fusion of indium. Specifically, approximately 2 mg of the sample is exactly weighed out and this is introduced into an aluminum pan, and the measurement is run at a ramp rate of 10° C./minute in the measurement temperature range from 30° C. to 200° C. using an empty aluminum pan as reference. The measurement is carried out by initially raising the temperature to 200° C., then cooling to 30° C., and then reheating. The change in the specific heat is obtained in the temperature range of 40° C. to 100° C. in this second heating process. In this case, the glass transition temperature Tg of the toner particle is taken to be the point at the intersection between the differential heat curve and the line for the midpoint for the baselines for prior to and subsequent to the appearance of the change in the specific heat.

Method for Measuring the Relaxation Enthalpy of the Toner

The relaxation enthalpy of the toner is measured based on ASTM D 3418-82 using a "Q1000" differential scanning calorimeter (TA Instruments).

Temperature correction in the instrument detection section is performed using the melting points of indium and zinc, and the amount of heat is corrected using the heat of fusion of indium.

Specifically, approximately 5 mg of the sample is exactly weighed out and this is introduced into an aluminum pan, and the measurement is run at a ramp rate of 10° C./minute in the measurement temperature range from 30° C. to 200° C. using an empty aluminum pan as reference. The relaxation enthalpy ΔH is the integrated value of the endothermic peak obtained immediately after the glass transition temperature Tg in the temperature range from 30° C. to 200° C. during the heating process. This ΔH can be obtained by determining the integrated value of the area (peak area) bounded by the base line and the DSC curve.

Method for Measuring the Peak Molecular Weight Mp of the Toner and the Weight-Average Molecular Weight Mw of the Amorphous Polyester The molecular weight distribution of the toner and amorphous polyester are measured as indicated below using gel permeation chromatography (GPC).

First, the sample is dissolved in tetrahydrofuran (THF) over 24 hours at room temperature. The obtained solution is filtered across a "Sample Pretreatment Cartridge" solvent-resistant membrane filter with a pore diameter of 0.2 μm (Tosoh Corporation) to obtain the sample solution. The sample solution is adjusted to a THF-soluble component concentration of approximately 0.8 mass %. The measurement is performed under the following conditions using this sample solution.

Instrument: HLC8120 GPC (detector: RI) (Tosoh Corporation)

Columns: 7-column train of Shodex KF-801, 802, 803, 804, 805, 806, and 807 (Showa Denko K.K.)

Eluent: tetrahydrofuran (THF)

Flow rate: 1.0 mL/minute

Oven temperature: 40.0° C.

Sample injection amount: 0.10 mL

The molecular weight calibration curve used to determine the molecular weight of the sample is constructed using polystyrene resin standards (product name: "TSK Standard Polystyrene F-850, F-450, F-288, F-128, F-80, F-40, F-20, F-10, F-4, F-2, F-1, A-5000, A-2500, A-1000, and A-500", Tosoh Corporation).

Method for Measuring the Softening Point of the Toner and Amorphous Polyester

The softening point of the toner and amorphous polyester is measured using a "Flowtester CFT-500D Flow Property Evaluation Instrument" (Shimadzu Corporation), which is a constant-load extrusion-type capillary rheometer, in accordance with the manual provided with the instrument. With this instrument, while a constant load is applied by a piston from the top of the measurement sample, the measurement sample filled in a cylinder is heated and melted and the melted measurement sample is extruded from a die at the bottom of the cylinder; a flow curve giving the relationship between piston stroke and temperature can be obtained from this process.

The "melting temperature by the ½ method", as described in the manual provided with the "Flowtester CFT-500D Flow Property Evaluation Instrument", is used as the softening point in the present invention. The melting temperature by the ½ method is determined as follows. First, ½ of the difference between the piston stroke at the completion of outflow Smax and the piston stroke at the beginning of outflow Smin is determined (this value is designated as X, where X=(Smax−Smin)/2). The temperature of the flow curve when the piston stroke in the flow curve reaches the sum of X and Smin is the melting temperature by the ½ method.

The measurement sample used is prepared by subjecting approximately 1.0 g of the toner or amorphous polyester to compression molding for approximately 60 seconds at approximately 10 MPa in a 25° C. environment using a tablet compression molder (for example, the NT-100H, NPa System Co., Ltd.) to provide a cylindrical shape with a diameter of approximately 8 mm.

The measurement conditions with the CFT-500D are as follows.

Test mode: ramp-up method
Start temperature: 50° C.
Saturated temperature: 200° C.
Measurement interval: 1.0° C.
Ramp rate: 4.0° C./minute
Piston cross section area: 1.000 $cm^2$
Test load (piston load): 10.0 kgf (0.9807 MPa)
Preheating time: 300 seconds
Diameter of die orifice: 1.0 mm
Die length: 1.0 mm Method for Measuring the Fixing Ratio of the Silica Fine Particles 20 g of "Contaminon N" (10 mass % aqueous solution of a neutral pH 7 detergent for cleaning precision measurement instrumentation, comprising a nonionic surfactant, anionic surfactant, and organic builder) is weighed into a 50-mL vial and mixed with 1 g of toner.

This is placed in a "KM Shaker" (model: V. SX) from Iwaki Co., Ltd., and shaking is carried out for 30 seconds with the speed set to 50. This serves to transfer the silica fine particles, as a function of the state of fixing of the silica fine particles, from the toner particle surface into the dispersion.

Subsequent to this, and in the case of a magnetic toner, the supernatant is separated while the toner particles are held using a neodymium magnet, and the sedimented toner is dried by vacuum drying (40° C./1 day) to provide the sample.

For the case of a nonmagnetic toner, the toner is separated from the transferred silica fine particles using a centrifugal separator (H-9R, Kokusan Co., Ltd.) (5 minutes at 1,000 rpm).

The toner is converted into a pellet using the press molder described below to provide the sample. Using the Si intensity in the wavelength-dispersive x-ray fluorescence analysis (XRF) indicated below, the silica fine particles are quantitated for the toner sample both before and after the execution of the aforementioned treatment. The amount of silica fine particles not transferred into the supernatant by the aforementioned treatment and remaining on the toner particle surface is determined using the formula given below, and this is used as the fixing ratio. The arithmetic average for 100 samples is used.

(i) Example of the Instrumentation Used

3080 Fluorescent X-ray Analyzer (Rigaku Corporation)

(ii) Sample Preparation

A sample press molder from Maekawa Testing Machine Mfg. Co., Ltd. is used for sample preparation. Conversion into the pellet is carried out by introducing 0.5 g of the toner into an aluminum ring (model number: 3481E1) and pressing for 1 minute with the load set to 5.0 tons.

(iii) Measurement Conditions

Measurement diameter: 10 Ø
Measurement potential: 50 kV voltage, 50 to 70 mA
2θ angle: 25.12°
Crystal plate: LiF
Measurement time: 60 seconds (iv) Procedure for Determining the Fixing Ratio for the Silica Fine Particles Fixing ratio (%) for the silica fine particles=
(Si intensity for the toner after treatment/
Si intensity for the toner before treatment)×100 [Formula]

Method for Measuring the Weight-Average Particle Diameter (D4)

Using a "Coulter Counter Multisizer 3" (registered trademark, Beckman Coulter, Inc.), a precision particle size distribution measurement instrument operating on the pore electrical resistance method and equipped with a 100 μm aperture tube, and the accompanying dedicated software, i.e., "Beckman Coulter Multisizer 3 Version 3.51" (Beckman Coulter, Inc.), for setting the measurement conditions and analyzing the measurement data, the weight-average particle diameter (D4) of the toner was determined by performing the measurement and analyzing.

The aqueous electrolyte solution used for the measurements is prepared by dissolving special-grade sodium chloride in deionized water to provide a concentration of approximately 1 mass %, and, for example, "ISOTON II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1600

μA; the gain is set to 2; the electrolyte is set to ISOTON II; and a check is entered for the post-measurement aperture tube flush.

In the "setting conversion from pulses to particle diameter" screen of the dedicated software, the bin interval is set to logarithmic particle diameter; the particle diameter bin is set to 256 particle diameter bins; and the particle diameter range is set to 2 μm to 60 μm.

The specific measurement procedure is as follows.

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are preliminarily removed by the "aperture tube flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (10 mass % aqueous solution of a neutral pH 7 detergent for cleaning precision measurement instrumentation, formed from a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is controlled as appropriate during ultrasound dispersion to be from 10° C. to 40° C.

(6) Using a pipette, the dispersed toner-containing aqueous electrolyte solution prepared in (5) is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "arithmetic diameter" on the analysis/volumetric statistical value (arithmetic average) screen is the weight-average particle diameter (D4).

Method for Measuring the Average Circularity of the Toner

The average circularity of the toner and the aspect ratio of the toner are measured using an "FPIA-3000" (Sysmex Corporation), a flow-type particle image analyzer, and using the measurement and analysis conditions from the calibration process.

The specific measurement method is as follows.

First, approximately 20 mL of deionized water from which solid impurities and so forth have been preliminarily removed, is introduced into a glass container. To this is added as dispersing agent approximately 0.2 mL of a dilution prepared by the approximately three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.). Approximately 0.02 g of the measurement sample is added and a dispersion treatment is carried out for 2 minutes using an ultrasound disperser to provide a dispersion to be used for the measurement. Cooling is carried out as appropriate during this process in order to have the temperature of the dispersion be from 10° C. to 40° C. A benchtop ultrasound cleaner/disperser that has an oscillation frequency of 50 kHz and an electrical output of 150 W (for example, the "VS-150" (Velvo-Clear Co., Ltd.)) is used as the ultrasound disperser, and a prescribed amount of deionized water is introduced into the water tank and approximately 2 mL of Contaminon N is added to the water tank.

The aforementioned flow-type particle image analyzer fitted with a "LUCPLFLN" objective lens (20×, numerical aperture: 0.40) is used for the measurement, and "PSE-900A" (Sysmex Corporation) particle sheath is used for the sheath solution. The dispersion prepared according to the procedure described above is introduced into the flow-type particle image analyzer and 2,000 of the toner are measured according to total count mode in HPF measurement mode. The average circularity and aspect ratio of the toner are determined with the binarization threshold value during particle analysis set at 85% and the analyzed particle diameter limited to a circle-equivalent diameter of from 1.977 μm to less than 39.54 μm.

For this measurement, automatic focal point adjustment is performed prior to the start of the measurement using reference latex particles (for example, a dilution with deionized water of "RESEARCH AND TEST PARTICLES Latex Microsphere Suspensions 5100A", Duke Scientific Corporation). After this, focal point adjustment is preferably performed every two hours after the start of measurement.

In the examples in this application, the flow-type particle image analyzer used had been calibrated by the Sysmex Corporation and had been issued a calibration certificate by the Sysmex Corporation. The measurements are carried out under the same measurement and analysis conditions as when the calibration certification was received, with the exception that the analyzed particle diameter was limited to a circle-equivalent diameter of from 1.977 μm to less than 39.54 μm.

Method for Measuring the 25% Area Ratio, 50% Area Ratio, and Domain Area Ratio

The toner is thoroughly dispersed in a visible light-curable resin (Aronix LCR Series D-800) followed by curing by exposure to short-wavelength light. The resulting cured material is sectioned using an ultramicrotome equipped with a diamond knife to prepare 250-nm thin-section samples. Observation of a toner particle cross section is then carried out using the sectioned samples and a transmission electron microscope (JEM-2800 electron microscope, JEOL Ltd.) (TEM-EDX) at a magnification of 40,000× to 50,000×, and element mapping is carried out by EDX.

The toner particle cross sections for observation are selected as follows. First, the cross-sectional area of a toner particle is determined from the toner cross-sectional image, and the diameter of the circle having an area equal to this cross-sectional area (the circle-equivalent diameter) is determined. Observation is performed only with toner particle cross-sectional images for which the absolute value of the difference between this circle-equivalent diameter and the weight-average particle diameter (D4) of the toner is within 1.0 μm.

The mapping conditions are a save rate of 9,000 to 13,000 and cumulation number of 120 times. In each particular resin-derived domain confirmed from the observed image the spectral intensity originating with the element C and the spectral intensity originating with the element 0 are measured, and the amorphous polyester domains are those domains for which the spectral intensity of the element C with respect to the element 0 is at least 0.05.

After the identification of the amorphous polyester domains, using binarization processing the area ratio (area %) is calculated—with respect to the total area of the amorphous polyester domains present in the toner particle cross section—for the amorphous polyester domains present within 25% of the distance from the contour of the toner particle cross section to the centroid of the cross section. Image Pro PLUS (Nippon Roper K.K.) is used for the binarization processing.

The calculation method is as follows. The contour and centroid of the toner particle cross section are determined using the aforementioned TEM image. The contour of the toner particle cross section is taken to be the contour along the toner particle surface observed in the TEM image.

A line is drawn from the obtained centroid to a point on the contour of the toner particle cross section. The location on this line that is 25%, from the contour, of the distance between the contour and the centroid of the cross section is identified.

This operation is carried out on the contour of the toner particle cross section for one time around, thus specifying the boundary line for 25% of the distance between the contour of the toner particle cross section and the centroid of the cross section.

Based on this TEM image in which the 25% boundary line has been identified, the area of the amorphous polyester domains present in the region bounded by the toner particle cross section contour and the 25% boundary line is measured. The total area of the amorphous polyester domains present in the toner particle cross section is also measured, and the area % is calculated with reference to this total area. The arithmetic average value for 100 of the toner is used.

50% Area Ratio

Proceeding as for the measurement of the 25% area ratio described above, the boundary line is identified that is 50% of the distance between the contour of the toner particle cross section and the centroid of the cross section. The area of the amorphous polyester domains present in the region bounded by the toner particle cross section contour and the 50% boundary line is measured, and the area % is calculated with reference to the total area of the domains. The arithmetic average value for 100 of the toner is used.

Domain Area Ratio

Using the calculated values obtained as described above, the following formula is used to obtain the ratio (domain area ratio) between the area of the amorphous polyester domains present within 25% of the distance between the contour of the toner particle cross section and the centroid of the cross section, and the area of the amorphous polyester domains present at 25% to 50% of the distance between the contour of the toner particle cross section and the centroid of the cross section.

$$\text{Domain area ratio}=(25\%\ \text{area ratio(area \%)})/[(50\%\ \text{area ratio(area \%)})-(25\%\ \text{area ratio(area \%)})]$$

Method for Measuring the Acid Value Av of the Amorphous Polyester

The acid value is the number of milligrams of potassium hydroxide required to neutralize the acid present in 1 g of a sample. The acid value of the amorphous polyester is measured in accordance with JIS K 0070-1992 and in specific terms is measured according to the following procedure.

(1) Reagent Preparation

A phenolphthalein solution is obtained by dissolving 1.0 g of phenolphthalein in 90 mL of ethyl alcohol (95 volume %) and bringing to 100 mL by adding deionized water.

7 g of special-grade potassium hydroxide is dissolved in 5 mL of water and this is brought to 1 L by the addition of ethyl alcohol (95 volume %). This is introduced into an alkali-resistant container avoiding contact with, for example, carbon dioxide, and allowed to stand for 3 days, after which time filtration is carried out to obtain a potassium hydroxide solution. The obtained potassium hydroxide solution is stored in an alkali-resistant container. The factor for this potassium hydroxide solution is determined from the amount of the potassium hydroxide solution required for neutralization when 25 mL of 0.1 mol/L hydrochloric acid is introduced into an Erlenmeyer flask, several drops of the aforementioned phenolphthalein solution are added, and titration is performed using the potassium hydroxide solution. The 0.1 mol/L hydrochloric acid used is prepared in accordance with JIS K 8001-1998.

(2) Procedure (A) Main Test 2.0 g of a sample of the pulverized amorphous polyester is exactly weighed into a 200-mL Erlenmeyer flask and 100 mL of a toluene/ethanol (2:1) mixed solution is added and dissolution is carried out over 5 hours. Several drops of the aforementioned phenolphthalein solution are added as indicator and titration is performed using the aforementioned potassium hydroxide solution. The titration endpoint is taken to be persistence of the faint pink color of the indicator for approximately 30 seconds.

(B) Blank Test

The same titration as in the above procedure is run, but without using the sample (that is, with only the toluene/ethanol (2:1) mixed solution).

(3) The acid value is calculated by substituting the obtained results into the following formula.

$$A=[(C-B)\times f\times 5.61]/S$$

Here, A: acid value (mg KOH/g); B: amount (mL) of addition of the potassium hydroxide solution in the blank test; C: amount (mL) of addition of the potassium hydroxide solution in the main test; f: factor for the potassium hydroxide solution; and S: mass of the sample (g).

Method for Measuring the Hydroxyl Value OHv of the Amorphous Polyester

The hydroxyl value is the number of milligrams of potassium hydroxide required to neutralize the acetic acid bonded with the hydroxyl group when 1 g of the sample is acetylated. The hydroxyl value of the amorphous polyester is measured based on JIS K 0070-1992 and in specific terms is measured according to the following procedure.

(1) Reagent Preparation 25 g of special-grade acetic anhydride is introduced into a 100-mL volumetric flask; the total volume is brought to 100 mL by the addition of pyridine; and thorough shaking then provides the acetylation reagent. The obtained acetylation reagent is stored in a brown bottle isolated from contact with, e.g., humidity, carbon dioxide, and so forth.

A phenolphthalein solution is obtained by dissolving 1.0 g of phenolphthalein in 90 mL of ethyl alcohol (95 vol %) and bringing to 100 mL by the addition of deionized water.

35 g of special-grade potassium hydroxide is dissolved in 20 mL of water and this is brought to 1 L by the addition of ethyl alcohol (95 vol %). After standing for 3 days in an alkali-resistant container isolated from contact with, e.g., carbon dioxide, filtration is performed to obtain a potassium hydroxide solution. The obtained potassium hydroxide solution is stored in an alkali-resistant container. The factor for this potassium hydroxide solution is determined as follows: 25 mL of 0.5 mol/L hydrochloric acid is taken to an Erlenmeyer flask; several drops of the above-described phenolphthalein solution are added; titration is performed with the potassium hydroxide solution; and the factor is determined from the amount of the potassium hydroxide solution required for neutralization. The 0.5 mol/L hydrochloric acid used is prepared in accordance with JIS K 8001-1998.

(2) Procedure (A) Main Test

A 1.0 g sample of the pulverized amorphous polyester is exactly weighed into a 200-mL roundbottom flask and exactly 5.0 mL of the above-described acetylation reagent is added from a whole pipette. When the sample is difficult to dissolve in the acetylation reagent, dissolution is carried out by the addition of a small amount of special-grade toluene.

A small funnel is mounted in the mouth of the flask and heating is then carried out by immersing about 1 cm of the bottom of the flask in a glycerol bath at approximately 97° C. In order at this point to prevent the temperature at the neck of the flask from rising due to the heat from the bath, thick paper in which a round hole has been made is preferably mounted at the base of the neck of the flask.

After 1 hour, the flask is taken off the glycerol bath and allowed to cool. After cooling, the acetic anhydride is hydrolyzed by adding 1 mL of water from the funnel and shaking. In order to accomplish complete hydrolysis, the flask is again heated for 10 minutes on the glycerol bath. After cooling, the funnel and flask walls are washed with 5 mL of ethyl alcohol.

Several drops of the above-described phenolphthalein solution are added as the indicator and titration is performed using the above-described potassium hydroxide solution. The endpoint for the titration is taken to be the point at which the pale pink color of the indicator persists for approximately 30 seconds.

(B) Blank Test

Titration is performed using the same procedure as described above, but without using the amorphous polyester sample.

(3) The hydroxyl value is calculated by substituting the obtained results into the following formula.

$$A=[\{(B-C)\times 28.05\times f\}/S]+D$$

Here, A: the hydroxyl value (mg KOH/g); B: the amount of addition (mL) of the potassium hydroxide solution in the blank test; C: the amount of addition (mL) of the potassium hydroxide solution in the main test; f: the factor for the potassium hydroxide solution; S: mass of the sample (g); and D: the acid value (mg KOH/g) of the amorphous polyester.

EXAMPLES

The specific constitution and characteristic features of the present invention are described in the preceding, while the present invention is specifically described below based on examples. However, the present invention is in no way limited by these examples. Unless specifically indicated otherwise, parts in the examples is on a mass basis.

Amorphous Polyester APES1 Production Example

The starting monomer, with the carboxylic acid component and alcohol component adjusted as shown in Table 1, was introduced into a reactor fitted with a nitrogen introduction line, a water separator, a stirrer, and a thermocouple, and 1.5 parts of an esterification catalyst (tin octylate) was subsequently added as catalyst per 100 parts of the overall amount of the monomer. Then, after rapidly raising the temperature to 180° C. at normal pressure under a nitrogen atmosphere, a polycondensation was run while distilling off the water while heating from 180° C. to 210° C. at a rate of 10° C./hour. After 210° C. had been reached, the pressure within the reactor was reduced to 5 kPa or below, and a polycondensation was run under conditions of 210° C. and 5 kPa or below to obtain an amorphous polyester APES1. The polymerization time here was adjusted so as to provide the value in Table 1 for the weight-average molecular weight of the resulting amorphous polyester APES1. The properties of the amorphous polyester APES1 are given in Table 1.

Long-Chain Monomer 1 Production Example 1,200 parts of an aliphatic hydrocarbon having a peak value for the number of carbons of 35 was introduced into a cylindrical reactor and 38.5 parts of boric acid was added at a temperature of 140° C. A mixed gas of 50 volume % air and 50 volume % nitrogen and having an oxygen concentration of approximately 10 volume % was immediately injected at a rate of 20 liter/minute, and, after reacting for 3.0 hours at 200° C., hot water was added to the reaction solution and hydrolysis for carried out for 2 hours at 95° C. After standing at quiescence, the reaction product upper lower was recovered. 20 parts of the modification product, i.e., the reaction product, was added to 100 parts of n-hexane and the unmodified component was dissolved and removed to obtain long-chain monomer 1. The obtained long-chain monomer 1 had a modification percentage of 94% and a hydroxyl value of 92.4 mg KOH/g.

Amorphous Polyesters APES2 to APES17 Production Example

Amorphous polyesters APES2 to APES17 were obtained proceeding as for amorphous polyester APES1, but changing the starting monomers and their use amounts as indicated in Table 1. The properties of these amorphous polyesters are given in Table 1.

Amorphous Polyester (APES18) Production Example

The following were introduced into a four-neck flask fitted with a nitrogen inlet line, water separator, stirrer, and thermocouple and a condensation polymerization reaction was run for 8 hours at 230° C.: 100 parts of the adduct of 2 moles of ethylene oxide on bisphenol A, 189 parts of the adduct of 2 moles of propylene oxide on bisphenol A, 51 parts of terephthalic acid, 61 parts of fumaric acid, 25 parts of adipic acid, and 2 parts of an esterification catalyst (tin octylate). The reaction was additionally run for 1 hour at 8 kPa and, after cooling to 160° C., a mixture of 6 parts of acrylic acid, 70 parts of styrene, 31 parts of n-butyl acrylate, and 20 parts of a polymerization initiator (di-t-butyl peroxide) was added by dropwise addition from a dropping funnel over 1 hour. After the dropwise addition, and while holding unchanged at 160° C., the addition polymerization reaction was continued for 1 hour; this was followed by heating to 200° C. and holding for 1 hour at 10 kPa. Subsequent removal of the unreacted acrylic acid, styrene, and butyl acrylate provided the amorphous polyester (APES18), which was a composite resin in which a vinyl polymer segment was bonded to a polyester polymer segment.

TABLE 1

Table of Properties of the Amorphous Polyesters

| Amorphous polyester No. | Alcohol component: Bisphenol A/PO adduct | Alcohol component: Long-chain monomer 1 | Carboxylic acid component: Terephthalic acid | Carboxylic acid component: Trimellitic anhydride | Carboxylic acid component: Fumaric acid (C4) | Carboxylic acid component: Adipic acid (C6) | Carboxylic acid component: Dodecanedioic acid (C12) | Charged molar ratio Carboxylic acid component/alcohol component | Acid value | Hydroxyl value | Tm (° C.) | Mw |
|---|---|---|---|---|---|---|---|---|---|---|---|---|
| APES1 | 100 | 0 | 48 | 5 | 0 | 35 | 0 | 0.88 | 7.0 | 30 | 95 | 12000 |
| APES2 | 100 | 0 | 48 | 3 | 0 | 35 | 0 | 0.86 | 4.0 | 30 | 95 | 9500 |
| APES3 | 100 | 0 | 39 | 1 | 0 | 48 | 0 | 0.88 | 0.5 | 30 | 84 | 10200 |
| APES4 | 100 | 0 | 37 | 1 | 0 | 50 | 0 | 0.88 | 0.1 | 30 | 84 | 10400 |
| APES5 | 100 | 0 | 20 | 6 | 55 | 0 | 0 | 0.81 | 9.0 | 35 | 80 | 6800 |
| APES6 | 92 | 8 | 47 | 8 | 0 | 35 | 0 | 0.90 | 15.0 | 35 | 100 | 13500 |
| APES7 | 100 | 0 | 40 | 5 | 0 | 38 | 0 | 0.83 | 6.0 | 15 | 84 | 7200 |
| APES8 | 100 | 0 | 74 | 4 | 0 | 0 | 10 | 0.88 | 6.0 | 40 | 98 | 11000 |
| APES9 | 100 | 0 | 30 | 6 | 50 | 0 | 0 | 0.86 | 8.0 | 30 | 82 | 7000 |
| APES10 | 100 | 0 | 27 | 6 | 55 | 0 | 0 | 0.88 | 9.0 | 35 | 90 | 10200 |
| APES11 | 100 | 0 | 52 | 1 | 0 | 35 | 0 | 0.88 | 1.0 | 40 | 96 | 10100 |
| APES12 | 91 | 9 | 48 | 6 | 0 | 35 | 0 | 0.89 | 10.0 | 30 | 96 | 10300 |
| APES13 | 100 | 0 | 46 | 7 | 0 | 35 | 0 | 0.88 | 12.0 | 16 | 95 | 10300 |
| APES14 | 100 | 0 | 50 | 5 | 0 | 35 | 0 | 0.90 | 6.0 | 30 | 100 | 13000 |
| APES15 | 100 | 0 | 55 | 5 | 0 | 35 | 0 | 0.95 | 6.0 | 30 | 100 | 20000 |
| APES16 | 100 | 0 | 99 | 1 | 0 | 0 | 0 | 0.90 | 1.0 | 10 | 125 | 10000 |
| APES17 | 100 | 0 | 48 | 5 | 0 | 35 | 0 | 0.88 | 6.0 | 30 | 92 | 10500 |
| APES18 | Described in the Specification | | | | | | | | | | | |

In the table, the numerical values for the alcohol component and carboxylic acid component are in mol parts and the bisphenol A/PO adduct is the adduct of 2 moles of propylene oxide. The unit of acid value and hydroxyl value is "mgKOH/g".

Treated Magnetic Body 1 Production Example

The following were mixed into an aqueous ferrous sulfate solution to produce an aqueous solution containing ferrous hydroxide: a sodium hydroxide solution at 1.00 to 1.10 equivalents with reference to the element iron, $P_2O_5$ in an amount that provided 0.15 mass % as the element phosphorus with reference to the element iron, and $SiO_2$ in an amount that provided 0.50 mass % as the element silicon with reference to the element iron. The pH of the aqueous solution was brought to 8.0 and an oxidation reaction was run at 85° C. while blowing in air to prepare a slurry that contained seed crystals.

An aqueous ferrous sulfate solution was then added to this slurry so as to provide 0.90 to 1.20 equivalents with reference to the initial amount of the alkali (sodium component in the sodium hydroxide), after which the oxidation reaction was developed while blowing in air and holding the pH of the slurry at 7.6 to obtain a slurry containing magnetic iron oxide. After filtration and washing, the water-containing slurry was temporarily taken up. At this point, a small amount of a water-containing sample was collected and the water content was measured.

Then, without drying, this water-containing sample was introduced into a separate aqueous medium and redispersion was performed with a pin mill while circulating and stirring the slurry and the pH of the redispersion was adjusted to approximately 4.8. While stirring, an n-hexyltrimethoxysilane coupling agent was added at 1.6 parts per 100 parts of the magnetic iron oxide (the amount of the magnetic iron oxide was calculated as the value provided by subtracting the water content from the water-containing sample) and hydrolysis was carried out. This was followed by thorough stirring and bringing the pH of the dispersion to 8.6 and the execution of a surface treatment. The produced hydrophobic magnetic body was filtered on a filter press and washed with a large amount of water, followed by drying for 15 minutes at 100° C. and 30 minutes at 90° C. and grinding of the resulting particles to obtain a treated magnetic body 1 having a volume-average particle diameter of 0.21 μm.

Toner Particle 1 Production Example

Preparation of a First Aqueous Medium

A first aqueous medium containing a dispersing agent was obtained by introducing 450 parts of a 0.1 mol/L aqueous $Na_3PO_4$ solution into 720 parts of deionized water; heating to a temperature of 60° C.; and then adding 67.7 parts of a 1.0 mol/L aqueous $CaCl_2$) solution.

Preparation of a Polymerizable Monomer Composition

| | |
|---|---|
| Styrene | 74 parts |
| n-Butyl acrylate | 26 parts |
| Divinylbenzene (crosslinking agent) | 0.4 parts |

-continued

| | |
|---|---|
| Amorphous polyester resin APES1 | 10 parts |
| T-77 negative-charging charge control agent (Hodogaya Chemical Co., Ltd.) | 1 part |
| Treated magnetic body 1 | 65 parts |

This formulation was dispersed and mixed to uniformity using an attritor (Mitsui Miike Chemical Engineering Machinery Co., Ltd.). This monomer composition was heated to a temperature of 60° C., and into this were mixed/dissolved 10 parts of paraffin wax (hydrocarbon wax) (melting point=78° C.) and 5 parts of ester wax (melting point=72° C.) as release agents and 7 parts of t-butyl peroxypivalate (25% toluene solution) as polymerization initiator to yield a polymerizable monomer composition.

Preparation of a Second Aqueous Medium

A second aqueous medium containing a dispersing agent was obtained by introducing 150 parts of a 0.1 mol/L aqueous $Na_3PO_4$ solution into 360 parts of deionized water; heating to a temperature of 60° C.; and then adding 22.6 parts of a 1.0 mol/L aqueous $CaCl_2$ solution.

Granulation/Polymerization/Filtration/Drying

The polymerizable monomer composition was introduced into the first aqueous medium, and granulation was carried out by stirring for 15 minutes at 10,000 rpm using a Model TK Homomixer (Tokushu Kika Kogyo Co., Ltd.) at a temperature of 60° C. and under an N2 atmosphere. The granulation solution was then added to the second aqueous medium, and a polymerization reaction was run for 300 minutes at a reaction temperature of 70° C. while stirring with a paddle stirring blade.

At this point, a small amount of the aqueous medium was sampled out; hydrochloric acid was added thereto and the calcium phosphate was washed out and removed; and filtration and drying were then performed and the colored particles were analyzed. According to the results, the colored particles (toner particle prior to the heating step) had a glass transition temperature Tg of 55° C.

The aqueous medium containing the dispersed colored particles was then heated to 100° C. and held for 120 minutes. 5° C. water was subsequently introduced into the aqueous medium to bring about cooling from 100° C. to 50° C. at a cooling rate of 300° C./minute. The aqueous medium was then held for 120 minutes at 50° C.

This was followed by the addition of hydrochloric acid to the aqueous medium and washing out and removing the calcium phosphate followed by filtration and drying to obtain toner particle 1.

TABLE 2

Table of Toner Particle Production Conditions

| Toner particle | Amorphous polyester | | Colorant | | Release agent 1 Ester wax | Release agent 2 hydrocarbon wax | Initiator | Crosslinking agent |
|---|---|---|---|---|---|---|---|---|
| No. | No. | parts | type | parts | parts | parts | parts | parts |
| 1 | 1 | 10 | Treated magnetic body 1 | 65 | 5 | 10 | 7 | 0.40 |
| 2 | 1 | 10 | Treated magnetic body 1 | 65 | 5 | 10 | 5 | 0.30 |
| 3 | 1 | 10 | Treated magnetic body 1 | 65 | 5 | 10 | 5 | 0.30 |
| 4 | 1 | 10 | Treated magnetic body 1 | 65 | 5 | 10 | 9 | 0.50 |
| 5 | 1 | 15 | Treated magnetic body 1 | 65 | 5 | 10 | 9 | 0.50 |
| 6 | 1 | 20 | Treated magnetic body 1 | 65 | 0 | 15 | 7 | 0.30 |
| 7 | 1 | 20 | Treated magnetic body 1 | 65 | 0 | 15 | 7 | 0.30 |
| 8 | 2 | 10 | Treated magnetic body 1 | 65 | 5 | 10 | 7 | 0.40 |
| 9 | 3 | 10 | Treated magnetic body 1 | 65 | 5 | 10 | 7 | 0.40 |
| 10 | 4 | 10 | Treated magnetic body 1 | 65 | 5 | 10 | 7 | 0.40 |
| 11 | 5 | 5 | Treated magnetic body 1 | 65 | 5 | 12 | 7 | 0.40 |
| 12 | 5 | 4 | Treated magnetic body 1 | 65 | 5 | 12 | 7 | 0.40 |
| 13 | 1 | 30 | Treated magnetic body 1 | 65 | 5 | 10 | 7 | 0.40 |
| 14 | 6 | 10 | Treated magnetic body 1 | 65 | 5 | 10 | 7 | 0.40 |
| 15 | 7 | 32 | Treated magnetic body 1 | 65 | 5 | 10 | 7 | 0.40 |
| 16 | 8 | 10 | Treated magnetic body 1 | 65 | 5 | 10 | 7 | 0.40 |
| 17 | 9 | 10 | Treated magnetic body 1 | 65 | 5 | 10 | 7 | 0.40 |
| 18 | 10 | 10 | Treated magnetic body 1 | 65 | 5 | 10 | 7 | 0.40 |
| 19 | 11 | 25 | Treated magnetic body 1 | 65 | 5 | 10 | 7 | 0.40 |
| 20 | 12 | 15 | Treated magnetic body 1 | 65 | 5 | 10 | 7 | 0.40 |
| 21 | 13 | 15 | Treated magnetic body 1 | 65 | 5 | 10 | 7 | 0.40 |
| 22 | 8 | 20 | Treated magnetic body 1 | 65 | 0 | 15 | 5 | 0.30 |
| 23 | 14 | 15 | Treated magnetic body 1 | 65 | 10 | 5 | 5 | 0.30 |
| 24 | 15 | 15 | Treated magnetic body 1 | 65 | 0 | 15 | 5 | 0.40 |
| 25 | | | | Described in text | | | | |
| 26 | 17 | 10 | Carbon black | 7 | 5 | 10 | 9 | 0.40 |
| 27 | | | | Described in text | | | | |
| 28 | 16 | 10 | Treated magnetic body 1 | 65 | 0 | 15 | 7 | 0.40 |
| 29 | 16 | 10 | Treated magnetic body 1 | 65 | 0 | 15 | 5 | 0.40 |
| 30 | 7 | 10 | Treated magnetic body 1 | 65 | 5 | 10 | 4 | 0.30 |
| 31 | | | | Described in text | | | | |
| 32 | 16 | 10 | Treated magnetic body 1 | 65 | 15 | 5 | 10 | 0.50 |
| 33 | | | | Described in text | | | | |

Carbon black: MA-100 (Mitsubishi Chemical Corporation)

Toner Particles 2 to 24, 26, 28 to 30, and 32 Production Example

Toner particles 2 to 24, 26, 28 to 30, and 32 were produced as in the production of toner particle 1, but changing the amorphous polyester and its amount of addition, the colorant and its amount of addition, the release agent and its amount of addition, the amount of addition for the initiator, and the amount of addition for the crosslinking agent as indicated in Table 2. The production conditions for each toner particle are given in Table 2.

Toner Particle 25 Production Example

Production of Crystalline Polyester 1

100.0 parts of sebacic acid as acid monomer 1, 1.6 parts of stearic acid as acid monomer 2, and 89.3 parts of 1,9-nonanediol as the alcohol monomer were introduced into a reactor fitted with a nitrogen introduction line, water separator, stirrer, and thermocouple. The temperature was raised to 140° C. while stirring and a reaction was run for 8 hours while heating at 140° C. under a nitrogen atmosphere and distilling out water at normal pressure. 0.57 parts of tin dioctylate was then added, after which the reaction was run while raising the temperature to 200° C. at 10° C./hour. The reaction was run for 2 hours after reaching 200° C., after which the pressure in the reactor was reduced to 5 kPa or below and the reaction was run at 200° C. while monitoring the molecular weight to obtain a crystalline polyester 1 having a weight-average molecular weight of 40,000 and a melting point of 70° C.

Toner Particle 25 Production

An aqueous medium containing a dispersing agent was obtained by introducing 450 parts of a 0.1 mol/L aqueous $Na_3PO_4$ solution into 720 parts of deionized water; heating to 60° C.; and then adding 67.7 parts of a 1.0 mol/L aqueous $CaCl_2$ solution. 1,6-hexanediol diacrylate was used as the crosslinking agent.

| | |
|---|---|
| Styrene | 78.0 parts |
| n-Butyl acrylate | 22.0 parts |
| 1,6-Hexanediol diacrylate | 0.65 parts |
| Iron complex of monoazo dye (T-77, Hodogaya Chemical Co., Ltd.) | 1.5 parts |
| Treated magnetic body 1 | 90.0 parts |
| Amorphous polyester resin APES16 | 5.0 parts |

This formulation was dispersed and mixed to uniformity using an attritor (Mitsui Miike Chemical Engineering Machinery Co., Ltd.). This monomer composition was heated to 63° C., and into it were mixed and dissolved 7.0 parts of crystalline polyester 1 and 10.0 parts of paraffin wax (hydrocarbon wax) (melting point=78° C.) and 10.0 parts of ester wax (melting point=72° C.) as release agents.

The monomer composition was introduced into the aforementioned aqueous medium, and granulation was carried out by stirring for 10 minutes at 12,000 rpm using a T K Homomixer (Tokushu Kika Kogyo Co., Ltd.) at 60° C. and under an N2 atmosphere. This was followed by the introduction of 9.0 mass parts (25% toluene solution) of the polymerization initiator t-butyl peroxypivalate while stirring with a paddle stirring blade, raising the temperature to 70° C., and reacting for 4 hours. After the end of the reaction, the suspension was heated to 100° C. and holding was carried out for 2 hours. This was followed by a cooling step of introducing water at normal temperature into the suspension to cool the suspension from 100° C. to 50° C. at a rate of 300° C./minute, holding for 100 minutes at 50° C., and spontaneous cooling to normal temperature (normal temperature in toner production is 25° C. in the following). The crystallization temperature of crystalline polyester 1 was 53° C. Hydrochloric acid was then added to the suspension and the dispersing agent was dissolved and thoroughly washed out followed by filtration and drying to obtain toner particle 25.

Toner Particle 27 Production Example

Preparation of Resin Particle Dispersion 1

| | |
|---|---|
| Styrene | 78.0 parts |
| n-Butyl acrylate | 20.0 parts |
| β-Carboxyethyl acrylate | 2.0 parts |
| 1,6-Hexanediol diacrylate | 0.4 parts |
| Dodecanethiol (Wako Pure Chemical Industries, Ltd.) | 0.7 parts |

These were mixed and dissolved and were then dispersed and emulsified in a flask with 1.0 part of an anionic surfactant (Neogen RK, DKS Co. Ltd.) dissolved in 250 parts of deionized water. 2 mass parts of ammonium persulfate dissolved in 50 parts of deionized water was introduced while slowly stirring and mixing for 10 minutes.

Then, after the interior of the system had been thoroughly substituted with nitrogen, the interior of the system was heated to 70° C. on an oil bath while stirring the flask, and emulsion polymerization was continued in this state for 5 hours. This yielded a resin particle dispersion 1 having a volume-average particle diameter of 0.18 μm, a solids concentration of 25%, a glass transition point of 56.5° C., and an Mw of 30,000.

Preparation of Resin Particle Dispersion 2

Amorphous polyester (APES18) was dispersed using as the disperser a Cavitron CD1010 (Eurotec, Ltd.) that had been modified to support high temperatures and high pressures. Specifically, a resin particle dispersion 2 having a number-average particle diameter of 0.20 μm and a solids concentration of 25.0 mass % was obtained using a composition ratio of 74 mass % deionized water, 1 mass % (as effective component) anionic surfactant (Neogen RK, DKS Co. Ltd.), and 25 mass % for the concentration of the amorphous polyester APES18, adjusting to a pH of 8.5 using ammonia, and operating the Cavitron under the following conditions: rotor rotation rate=60 Hz, pressure=5 kg/cm$^2$, heating to 140° C. with a heat exchanger.

Preparation of Wax Dispersion

| | |
|---|---|
| Paraffin wax (HNP-9, Nippon Seiro Co., Ltd.) | 50.0 parts |
| Anionic surfactant (Neogen RK, DKS Co. Ltd.) | 0.3 parts |
| Deionized water | 150.0 parts |

These were mixed and heated to 95° C. and were dispersed using a homogenizer (Ultra-Turrax T50, IKA). This was followed by dispersion processing using a Manton-Gaulin high-pressure homogenizer (Gaulin Co.) to prepare a wax dispersion 1 (solids concentration: 25%) in which the wax was dispersed. The volume-average particle diameter of the wax was 0.20 μm.

Production of Magnetic Iron Oxide 1

55 liters of a 4.0 mol/L aqueous sodium hydroxide solution was mixed with stirring into 50 liters of an aqueous ferrous sulfate solution containing $Fe^{2+}$ at 2.0 mol/L to obtain an aqueous ferrous salt solution that contained colloidal ferrous hydroxide. An oxidation reaction was run while holding this aqueous solution at 85° C. and blowing in air at 20 L/minute to obtain a slurry that contained core particles.

The obtained slurry was filtered and washed on a filter press, after which the core particles were reslurried by redispersion in water. To this reslurry liquid was added sodium silicate to provide 0.20 mass % as silicon per 100 parts of the core particles; the pH of the slurry was adjusted to 6.0; and magnetic iron oxide particles having a silicon-rich surface were obtained by stirring. The obtained slurry was filtered and washed with a filter press and was reslurried with deionized water. Into this reslurry liquid (solids fraction=50 g/L) was introduced 500 g (10 mass % relative to the magnetic iron oxide) of the ion-exchange resin SK110 (Mitsubishi Chemical Corporation) and ion-exchange was carried out for 2 hours with stirring. This was followed by removal of the ion-exchange resin by filtration on a mesh; filtration and washing on a filter press; and drying and crushing to obtain a magnetic iron oxide 1 having a volume-average particle diameter of 0.21 μm.

Preparation of a Magnetic Body Dispersion

| | |
|---|---|
| Magnetic iron oxide 1 | 25.0 parts |
| Deionized water | 75.0 parts |

These materials were mixed and were then dispersed for 10 minutes at 8,000 rpm using a homogenizer (Ultra-Turrax T50, IKA). The volume-average diameter checked after dispersion was 0.23 μm.

Production of Toner Particle 27

| | |
|---|---|
| Resin particle dispersion 1 (solids fraction = 25.0 mass %) | 135.0 parts |
| Resin particle dispersion 2 (solids fraction = 25.0 mass %) | 15.0 parts |
| Wax dispersion 1 (solids fraction = 25.0 mass %) | 15.0 parts |
| Magnetic body dispersion 1 (solids fraction = 25.0 mass %) | 105.0 parts |

were introduced into a beaker; the total number of parts of water was adjusted to 250 parts; the temperature was then adjusted to 30.0° C.; and mixing was subsequently carried out by stirring for 1 minute at 5,000 rpm using a homogenizer (Ultra-Turrax T50, IKA). 10.0 parts of a 2.0% aqueous solution of magnesium sulfate was also gradually added as an aggregating agent.

This starting dispersion was transferred to a reaction kettle fitted with a stirrer and thermometer, and aggregated particle growth was promoted by heating with a mantle heater to 50.0° C. and stirring.

At the stage at which one hour had elapsed, 200.0 parts of a 5.0 mass % aqueous solution of ethylenediaminetetraacetic acid (EDTA) was added to prepare an aggregated particle dispersion 1.

The pH of the aggregated particle dispersion 1 was then adjusted to 8.0 using a 0.1 mol/L aqueous sodium hydroxide solution, followed by heating to 80.0° C. and standing for 3 hours to carry out aggregated particle coalescence. After the 3 hours had elapsed, a toner particle dispersion 1, in which toner particles were dispersed, was obtained. Cooling was performed at a cooling rate of 1.0° C./minute, followed by filtration of the toner particle dispersion 1 and washing by water throughflow with ion-exchanged water. The particle cake was recovered when the conductivity of the filtrate reached to 50 mS or less.

The particle cake was then introduced into deionized water in an amount that was 20 times the weight of the particles. The particles were thoroughly dispersed by stirring with a Three-One motor, after which another filtration and washing by water throughflow were performed and solid-liquid separation was carried out. The resulting particle cake was pulverized with a sample mill and dried for 24 hours in a 40° C. oven. The resulting powder was pulverized with a sample mill and then additionally vacuum dried for 5 hours in a 40° C. oven to obtain toner particle 27.

Toner Particle 31 Production Example

Synthesis of Low-Molecular Weight Polyester 1

The following starting materials were introduced into a heat-dried two-neck flask while nitrogen was being introduced.

| | |
|---|---|
| 2 mol adduct of ethylene oxide on bisphenol A: | 229 parts |
| 3 mol adduct of propylene oxide on bisphenol A: | 529 parts |
| Terephthalic acid: | 208 parts |
| Adipic acid: | 46 parts |
| Dibutyltin oxide: | 2 parts |

After the interior of the system had been substituted by nitrogen using a pressure reduction procedure, stirring was performed for 5 hours at 215° C. Then, while continuing to stir, the temperature was gradually raised to 230° C. under reduced pressure and was held for an additional 3 hours. This was followed by the introduction to the two-neck flask of 44 parts of trimellitic anhydride and reaction for 2 hours at 180° C. and normal pressure to obtain low-molecular weight polyester 1.

Release Agent Dispersion 1 Production

| | |
|---|---|
| Release agent 1 (paraffin wax, melting point = 78° C.): | 10 parts |
| Low-molecular weight polyester 1: | 25 parts |
| Ethyl acetate: | 67.5 parts |
| Deionized water: | 200.0 parts |

The preceding were mixed; 3-mm zirconia was introduced at a 60% volume ratio; and, using a Model No. 5400 Paint Conditioner (Red Devil Equipment Co. (USA)), dispersion was carried out until a weight-average particle diameter (D4) of 400 nm was reached, thus yielding a release agent dispersion 1.

Release Agent Dispersion 2 Production

A release agent dispersion 2 was produced proceeding as in Release Agent Dispersion 1 Production, but changing from release agent 1 to release agent 2 (ester wax, melting point=72° C.) and proceeding so as to obtain a weight-average particle diameter (D4) of 1.5 μm.

Synthesis of Amorphous Resin 1

The following starting materials were charged to a heat-dried two-neck flask while introducing nitrogen.

| | |
|---|---|
| Polyoxypropylene(2.2)-2,2-bis(4-hydroxyphenyl)propane | 30 parts |
| Polyoxyethylene(2.2)-2,2-bis(4-hydroxyphenyl)propane | 34 parts |
| Terephthalic acid | 30 parts |
| Fumaric acid | 6 parts |
| Dibutyltin oxide | 0.1 parts |

The interior of the system was substituted with nitrogen by a reduced pressure procedure followed by stirring for 5 hours at 215° C. Then, while continuing to stir, the temperature was gradually raised to 230° C. under reduced pressure and holding was carried out for an additional 2 hours. When a viscous state had been assumed, air cooling was carried out and the reaction was stopped to yield an amorphous resin 1, which was an amorphous polyester.

Resin Particle Dispersion 1 Production 50.0 parts of the amorphous resin 1 was dissolved in 200.0 parts of ethyl acetate, and 3.0 parts of an anionic surfactant (sodium dodecylbenzenesulfonate) along with 200.0 parts of deionized water were added. Heating to 40° C. was carried out; stirring was performed for 10 minutes at 8,000 rpm using an emulsifying device (Ultra-Turrax T-50, IKA); and the ethyl acetate was then removed by evaporation to obtain a resin particle dispersion 1.

Colorant Dispersion 1 Preparation

| | |
|---|---|
| Carbon black (MA-100, Mitsubishi Chemical Corporation): | 50.0 parts |
| Neogen RK (DKS Co. Ltd.) anionic surfactant: | 5.0 parts |
| Deionized water: | 200.0 parts |

These materials were introduced into a heat-resistant glass vessel; dispersion was carried out for 5 hours using a Model No. 5400 Paint Conditioner (Red Devil Equipment Co. (USA)); and the glass beads were removed using a nylon mesh to obtain a colorant dispersion 1 having a median diameter (D50) on a volume basis of 220 nm and a solids fraction of 20 mass %.

Toner Particle 31 Production Step

| | |
|---|---|
| Colorant dispersion 1: | 25.0 parts |
| Release agent dispersion 1: | 30.0 parts |
| Release agent dispersion 2: | 30.0 parts |
| 10% aqueous polyaluminum chloride solution: | 1.5 parts |

The preceding were mixed in a round stainless steel flask and were mixed and dispersed with an Ultra-Turrax T50 from IKA followed by holding for 60 minutes at 45° C. while stirring. The resin particle dispersion 1 (50 parts) was then gently added; the pH in the system was brought to 6 with a 0.5 mol/L aqueous sodium hydroxide solution; the stainless steel flask was subsequently sealed; and heating to 96° C. was performed while continuing to stir using a magnetic seal. While the temperature was being ramped up, supplementary additions of the aqueous sodium hydroxide solution were made as appropriate so the pH did not fall below 5.5. Holding for 5 hours at 96° C. was then carried out.

This was followed by cooling, filtration, thorough washing with deionized water, and then solid-liquid separation using Nutsche-type suction filtration. Redispersion into 3 L of deionized water was performed and stirring was carried out for 15 minutes at 300 rpm. This was repeated an additional 5 times, and, once the pH of the filtrate had reached 7.0, solid-liquid separation was performed using filter paper and Nutsche-type suction filtration. Vacuum drying was continued for 12 hours to obtain toner particle 31.

Toner Particle 33 Production Example

Toner particle 33 was produced proceeding as in the production of toner particle 25, but changing the 0.65 parts for the amount of crosslinking agent addition to 0.40 parts.

Example 1

Toner Production

Toner 1 Production Example

The following were mixed for 5 minutes at a peripheral velocity of 42 m/second using a Mitsui Henschel mixer (FM) (Model FM10C, Mitsui Miike Chemical Engineering Machinery Co., Ltd.): 100 parts of toner particle 1, 0.3 parts of sol-gel silica fine particles that had a number-average particle diameter of 115 nm and that had been treated with octyltrimethoxysilane, and 0.6 parts of fumed silica fine particles that had a number-average particle diameter of 12 nm and that had been treated with hexamethyldisilazane/polydimethylsilicone. A heat treatment was then performed using the apparatus shown in FIG. 1.

With regard to the structure of the apparatus shown in FIG. 1, an apparatus was used that had a diameter for the inner circumference of the main casing 31 of 130 mm and a volume for the processing space 39 of $2.0\times10^{-3}$ $m^3$. The rated power of the drive member 38 was 5.5 kW, and the stirring members 33 had the shape indicated in FIG. 2. In addition, the overlap width d between a stirring member 33*a* and a stirring member 33*b* in FIG. 2 was 0.25D with respect to the maximum width D of a stirring member 33, and the clearance between a stirring member 33 and the inner circumference of the main casing 31 was 3.0 mm. Hot water was injected through the jacket so as to bring the temperature within the starting material inlet port inner piece 316 to 55° C.

The aforementioned external addition-treated toner was introduced into the apparatus shown in FIG. 1 with the structure described above, followed by a 5-minute heat treatment while adjusting the peripheral velocity of the outermost tip of the stirring members 33 so as to make the power from the drive member 38 constant at $1.5\times10^{-2}$ W/g.

After the completion of the heat treatment, sieving was performed on a mesh with an aperture of 75 μm to yield toner 1. The production conditions are given in Table 3, and the properties are given in Table 4.

TABLE 3

Toner Production Conditions

| | | | First stage | | | Second stage | | | |
|---|---|---|---|---|---|---|---|---|---|
| Toner No. | Toner particle No. | Tg (° C.) | Apparatus | Rotation rate (rpm) | Rotation time (min) | Apparatus | Temperature (° C.) | Power (w/g) | Time (min) |
| 1 | 1 | 55 | FM | 3600 | 5 | FIG. 2 | 55 | 0.1 | 5 |
| 2 | 2 | 54 | FM | 3600 | 5 | FIG. 2 | 55 | 0.1 | 5 |
| 3 | 3 | 53 | FM | 3600 | 5 | FIG. 2 | 60 | 0.1 | 2 |
| 4 | 4 | 55 | FM | 3600 | 5 | FIG. 2 | 50 | 0.1 | 5 |
| 5 | 5 | 54 | FM | 3600 | 5 | FIG. 2 | 50 | 0.1 | 5 |
| 6 | 6 | 55 | FM | 3600 | 5 | FIG. 2 | 55 | 0.1 | 5 |
| 7 | 7 | 55 | FM | 3600 | 5 | FIG. 2 | 45 | 0.1 | 3 |
| 8 | 8 | 55 | FM | 3600 | 5 | FIG. 2 | 55 | 0.1 | 8 |
| 9 | 9 | 55 | FM | 3600 | 5 | FIG. 2 | 60 | 0.1 | 2 |
| 10 | 10 | 55 | FM | 3600 | 5 | FIG. 2 | 60 | 0.1 | 2 |
| 11 | 11 | 54 | FM | 3600 | 5 | FIG. 2 | 50 | 0.1 | 5 |
| 12 | 12 | 55 | FM | 3600 | 5 | FIG. 2 | 50 | 0.1 | 5 |

TABLE 3-continued

| Toner Production Conditions | | | | | | | | | |
|---|---|---|---|---|---|---|---|---|---|
| | | | First stage | | | Second stage | | | |
| Toner No. | Toner particle No. | Tg (° C.) | Apparatus | Rotation rate (rpm) | Rotation time (min) | Apparatus | Temperature (° C.) | Power (w/g) | Time (min) |
| 13 | 13 | 54 | FM | 3600 | 5 | FIG. 2 | 50 | 0.1 | 5 |
| 14 | 14 | 55 | FM | 3600 | 5 | FIG. 2 | 55 | 0.1 | 5 |
| 15 | 15 | 54 | FM | 3600 | 5 | FIG. 2 | 50 | 1 | 5 |
| 16 | 16 | 54 | FM | 3600 | 5 | FIG. 2 | 55 | 0.1 | 5 |
| 17 | 17 | 55 | FM | 3600 | 5 | FIG. 2 | 55 | 0.1 | 5 |
| 18 | 18 | 55 | FM | 3600 | 5 | FIG. 2 | 55 | 0.1 | 5 |
| 19 | 19 | 54 | FM | 3600 | 5 | FIG. 2 | 50 | 0.1 | 5 |
| 20 | 20 | 54 | FM | 3600 | 5 | FIG. 2 | 55 | 0.1 | 5 |
| 21 | 21 | 54 | FM | 3600 | 5 | FIG. 2 | 55 | 0.1 | 5 |
| 22 | 22 | 55 | FM | 3600 | 5 | FIG. 2 | 55 | 0.1 | 8 |
| 23 | 23 | 54 | FM | 3600 | 5 | FIG. 2 | 40 | 0.1 | 3 |
| 24 | 24 | 55 | FM | 3600 | 5 | FIG. 2 | 45 | 0.1 | 2 |
| 25 | 25 | 55 | FM | 3600 | 5 | FIG. 2 | 55 | 0.1 | 5 |
| 26 | 26 | 55 | FM | 3600 | 5 | FIG. 2 | 50 | 0.1 | 5 |
| 27 | 27 | 55 | FM | 3600 | 5 | FIG. 2 | 45 | 0.1 | 5 |
| 28 | 28 | 55 | FM | 3600 | 5 | FIG. 2 | 55 | 0.1 | 5 |
| 29 | 29 | 54 | FM | 3600 | 5 | FIG. 2 | 55 | 0.1 | 1 |
| 30 | 30 | 55 | FM | 3600 | 5 | FIG. 2 | 55 | 0.1 | 1 |
| 31 | 31 | 55 | FM | 3600 | 5 | — | — | — | — |
| 32 | 32 | 54 | FM | 3600 | 5 | — | — | — | — |
| 33 | 33 | 55 | FM | 3600 | 5 | FIG. 2 | 45 | 0.1 | 10 |

TABLE 4

| Table of Toner Properties | | | | | | | | | | | | | | |
|---|---|---|---|---|---|---|---|---|---|---|---|---|---|---|
| Toner No. | D4 μm | AC (—) | Tg (° C.) | Mp | Tε ° C. | Load X (mN) | Softening point of toner (° C.) | 25% area ratio (area %) | 50% area ratio (area %) | DA (—) | G' × $10^7$ Pa | THF (%) | ΔH (J/g) | FS (%) |
| 1 | 7.8 | 0.975 | 55 | 22000 | 61 | 1.25 | 125 | 50 | 91 | 1.22 | 25.00 | 15 | 1.5 | 89.9 |
| 2 | 7.8 | 0.974 | 54 | 28000 | 63 | 1.34 | 125 | 51 | 92 | 1.24 | 20.00 | 10 | 1.5 | 80.5 |
| 3 | 7.9 | 0.973 | 53 | 28000 | 64 | 1.38 | 125 | 51 | 92 | 1.24 | 20.00 | 10 | 1.4 | 79.5 |
| 4 | 7.8 | 0.974 | 55 | 18000 | 59 | 1.15 | 115 | 52 | 90 | 1.37 | 6.50 | 5 | 1.6 | 85.6 |
| 5 | 7.8 | 0.975 | 54 | 18000 | 56 | 1.12 | 112 | 53 | 90 | 1.43 | 5.50 | 5 | 1.6 | 87.5 |
| 6 | 7.8 | 0.974 | 55 | 22000 | 64 | 1.40 | 140 | 59 | 93 | 1.74 | 40.00 | 10 | 1.6 | 83.5 |
| 7 | 7.8 | 0.973 | 55 | 22000 | 65 | 1.45 | 142 | 58 | 93 | 1.66 | 30.00 | 10 | 2.6 | 74.0 |
| 8 | 7.8 | 0.972 | 55 | 22000 | 63 | 1.20 | 125 | 45 | 89 | 1.02 | 30.00 | 15 | 1.3 | 96.1 |
| 9 | 7.8 | 0.971 | 55 | 22000 | 67 | 1.22 | 125 | 30 | 82 | 0.58 | 30.00 | 15 | 1.4 | 82.5 |
| 10 | 7.8 | 0.973 | 55 | 22000 | 68 | 1.23 | 124 | 28 | 80 | 0.54 | 30.00 | 15 | 1.4 | 81.5 |
| 11 | 7.8 | 0.972 | 54 | 22000 | 67 | 1.13 | 118 | 40 | 98 | 0.69 | 15.00 | 20 | 1.5 | 85.4 |
| 12 | 7.8 | 0.973 | 55 | 22000 | 68 | 1.10 | 118 | 38 | 98 | 0.63 | 15.00 | 20 | 1.5 | 85.5 |
| 13 | 7.8 | 0.972 | 54 | 22000 | 55 | 1.09 | 122 | 68 | 95 | 2.52 | 25.00 | 15 | 1.5 | 87.5 |
| 14 | 7.8 | 0.974 | 55 | 22000 | 60 | 1.30 | 126 | 70 | 99 | 2.41 | 25.00 | 15 | 1.6 | 90.2 |
| 15 | 7.8 | 0.972 | 54 | 22000 | 53 | 1.05 | 122 | 72 | 96 | 3.00 | 25.00 | 15 | 2.4 | 99.5 |
| 16 | 7.8 | 0.973 | 54 | 22000 | 66 | 1.27 | 128 | 45 | 88 | 1.05 | 25.00 | 15 | 1.5 | 88.8 |
| 17 | 7.8 | 0.970 | 55 | 22000 | 60 | 1.20 | 126 | 65 | 94 | 2.24 | 25.00 | 15 | 1.5 | 90.5 |
| 18 | 7.8 | 0.975 | 55 | 22000 | 58 | 1.18 | 125 | 68 | 95 | 2.52 | 25.00 | 15 | 1.4 | 90.7 |
| 19 | 7.8 | 0.973 | 54 | 22000 | 62 | 1.15 | 123 | 40 | 82 | 0.95 | 25.00 | 15 | 1.6 | 88.8 |
| 20 | 7.8 | 0.977 | 54 | 22000 | 60 | 1.25 | 124 | 60 | 95 | 1.71 | 25.00 | 15 | 1.5 | 87.9 |
| 21 | 7.8 | 0.975 | 54 | 22000 | 59 | 1.29 | 123 | 62 | 95 | 1.88 | 25.00 | 15 | 1.5 | 90.8 |
| 22 | 7.8 | 0.973 | 55 | 26000 | 67 | 1.50 | 131 | 55 | 88 | 1.67 | 35.00 | 5 | 1.2 | 95.9 |
| 23 | 7.8 | 0.972 | 54 | 26000 | 70 | 1.20 | 130 | 50 | 95 | 1.11 | 27.00 | 10 | 2.6 | 73.5 |
| 24 | 7.8 | 0.973 | 55 | 26000 | 70 | 1.50 | 138 | 40 | 82 | 0.95 | 38.00 | 20 | 2.8 | 70.0 |
| 25 | 7.8 | 0.974 | 55 | 18000 | 60 | 1.20 | 130 | — | — | — | 40.00 | 5 | 1.5 | 92.3 |
| 26 | 7.0 | 0.972 | 55 | 19000 | 64 | 1.15 | 118 | 45 | 89 | 1.02 | 20.00 | 5 | 1.6 | 89.5 |
| 27 | 7.5 | 0.974 | 55 | 13000 | 50 | 1.00 | 108 | 39 | 77 | 1.03 | 3.00 | 5 | 2.2 | 93.5 |
| 28 | 7.4 | 0.972 | 55 | 22000 | 71 | 1.15 | 125 | — | — | — | 12.00 | 15 | 1.5 | 88.8 |
| 29 | 7.4 | 0.973 | 54 | 26000 | 75 | 1.60 | 140 | — | — | — | 15.00 | 15 | 2.8 | 70.2 |
| 30 | 7.4 | 0.971 | 55 | 29000 | 69 | 1.60 | 140 | 55 | 95 | 1.38 | 30.00 | 20 | 2.8 | 69.9 |
| 31 | 6.0 | 0.970 | 55 | 13000 | 64 | 0.90 | 120 | — | — | — | 2.20 | 5 | 3.1 | 69.5 |
| 32 | 6.0 | 0.971 | 54 | 16000 | 65 | 0.75 | 110 | — | — | — | 1.90 | 2 | 3.2 | 72.0 |
| 33 | 7.6 | 0.975 | 55 | 19000 | 48 | 1.00 | 110 | — | — | — | 8.00 | 5 | 2.2 | 70.0 |

In the table 4, AC indicates "Average circularity", DA indicates "Domain area ratio", G' indicates "Storage elastic modulus G' at Tε", THF indicates "THF-insoluble matter in toner", ΔH indicates "Relaxation enthalpy", and FS indicates "Fixing ratio of silica".

Evaluation of Storage Stability

Approximately 10 g of toner 1 was placed in a 100-mL plastic cup, and this was held for 12 hours in a low-temperature, low-humidity environment (15° C., 10% RH) followed by transition to a high-temperature, high-humidity environment (55° C., 95% RH) over 12 hours. Standing in this environment for 12 hours was followed by transitioning to the low-temperature, low-humidity environment (15° C., 10% RH) again over 12 hours. After three cycles of this process had been performed, the toner was removed and checked for cohesion. The time chart for the heat cycling is shown in FIG. 3. A C or better was regarded as excellent.

Criteria for Evaluating the Heat-Resistant Storability

A: Cohesion is entirely absent; condition approximately the same as at the start.

B: Impression of some cohesion, a condition which is broken up by gently shaking the plastic cup five times.

C: Impression of cohesion, a condition which is easily broken up by loosening with a finger.

D: Substantial cohesion is produced.

Image-Forming Apparatus 100 g of toner 1 was filled into a cartridge (CF230X) for an HP printer (LaserJet Pro M203dw) and the evaluations indicated below were performed.

In the repeat use testing, 1,000 prints in 1 day for a total of 4,000 prints (4 days) were made of a horizontal line image having a print percentage of 1%. The prints were made in a low-temperature, high-humidity environment (10° C./60% RH) using a two-sheet intermittent paper feed. Business 4200 (Xerox Corporation) having an areal weight of 75 g/m$^2$ was used as the evaluation paper used in the repeat use testing.

In view of the higher speeds anticipated for the future, a modification was made in which the process speed of the machine was changed to boost the speed from 30 ppm to 33 ppm. The results of the individual evaluations are given in Table 5.

The evaluation methods for each of the evaluations carried out in the examples of the present invention and the comparative examples, as well as the corresponding evaluation criteria, are described in the following.

Development Ghosts

To evaluate development ghosts, a plurality of 10 mm×10 mm solid images were formed on the front half of the transfer paper and a 2 dot×3 space halftone image was formed on the rear half. The degree to which traces of the solid image appeared on the halftone image was visually graded according to the following scale. With regard to the timing of the evaluation, the evaluation was carried out after the feed of 3,000 sheets according to the repeat use test described above. The results are given in Table 5. A C or better was regarded as excellent.

A: Ghosting is not produced.

B: Ghosting is produced to a very minor degree.

C: Ghosting is produced to a minor degree.

D: Ghosting is produced to a substantial degree.

On-Drum Post-Black Fogging

The fogging was measured using a Reflectometer Model TC-6DS from Tokyo Denshoku Co., Ltd. A green filter was used for the filter. For the "on-drum post-black fogging", 4,000 prints were made according to the repeat use test described above; this was immediately followed by the output of a solid black image; immediately after transfer of the solid black image, Mylar tape was applied to and stripped from a region of the photosensitive drum that corresponded to a white background region (nonimage area); and the Mylar tape was applied to paper. A difference is calculated by subtracting the reflectance for the stripped-off Mylar tape applied to virgin paper, from the reflectance for only the Mylar tape applied to virgin paper.

A C or better was regarded as excellent for the present invention.

A: Less than 5.0%; not visible even when transferred to paper.

B: 5.0% or more and less than 10.0%; very slightly visible when transferred to paper.

C: 10.0% or more and less than 20.0%; somewhat visible when transferred to paper.

D: 20.0% or more; significantly visible when transferred to paper.

Evaluation of Back-End Offset

Figure 4:
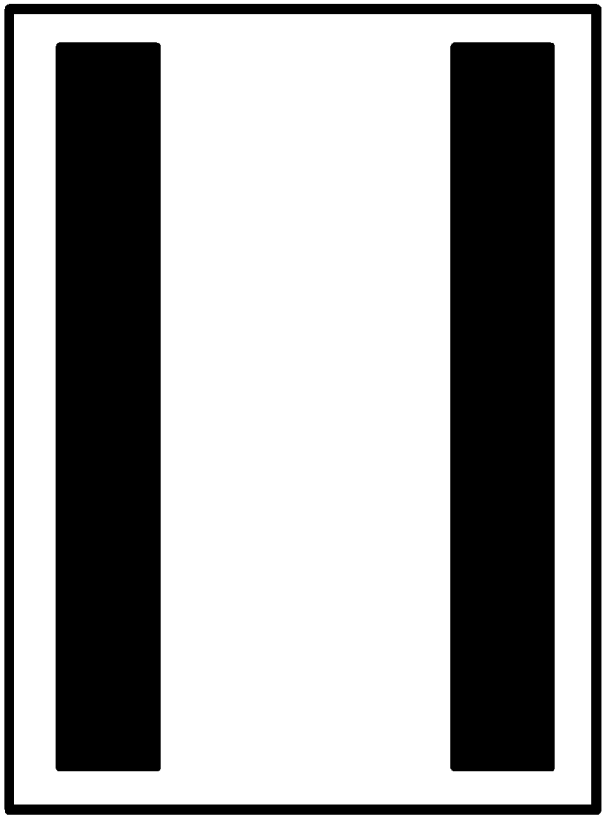
FIG. 4 is an example of an image for evaluating back-end offset.

For the evaluation image, the solid vertical stripe image shown in FIG. 4 was printed on A4 Oce Red Label paper (areal weight=80 g/m$^2$, Canon, Inc.), with adjustment to provide 5 mm margins on both the right and left and 5 mm margins on both the top and bottom. By using such an image in which toner is not laid on in the thermistor zone of the fixing unit, more severe conditions are established for the evaluation of fixing since temperature adjustment and control is not applied. Using this adjusted image, the presence/absence of back-end offset is visually checked at each fixation temperature while changing the temperature setting in 5° C. intervals in the fixation temperature range from 180° C. to 210° C.

The lower limit temperature at which back-end offset was not produced was evaluated according to the following criteria (C or better is regarded as excellent).

A: Not produced at 180° C.

B: Produced at 180° C., but not produced at 185° C.

C: Produced at 185° C., but not produced at 190° C.

D: Produced at 190° C.

Evaluation of Contamination of the Charging Roller

The status of the surface of the charging roller is visually checked every 1,000 prints (1 day) during the 4,000-print repeat use test described above. The following day, the electrostatic latent image bearing member is changed out for a new one and a halftone image is output and image evaluation is visually performed using the criteria given below. A C or better was regarded as excellent.

A: Both the roller surface and the image are entirely free of defects.

B: The surface of the roller presents some contamination on the following day after 4,000 prints have been output; however, no defects are seen in the halftone image output at this time.

C: The surface of the roller presents some contamination on the following day after 3,000 prints have been output, and some image density non-uniformity is produced in the halftone image output at this time.

D: The surface of the roller presents some contamination on the following day after 3,000 prints have been output, and there is conspicuous image density non-uniformity in the halftone image output at this time.

TABLE 5

Table for the Results of the Toner Evaluations

| Example No. | Toner No. | Storability post-heat cycling | Development ghost after 3,000 prints | Back-end offset | On-drum post-black fogging 2,000 prints | On-drum post-black fogging 4,000 prints | Charging roller contamination |
|---|---|---|---|---|---|---|---|
| 1 | 1 | A | A | A(180) | A(2.8) | A(4.3) | A |
| 2 | 2 | A | A | A(180) | A(2.5) | A(4.0) | A |
| 3 | 3 | A | A | B(185) | A(2.3) | A(3.7) | B |
| 4 | 4 | B | A | A(180) | A(3.5) | B(7.5) | A |
| 5 | 5 | B | A | A(180) | A(4.5) | B(8.2) | A |
| 6 | 6 | A | A | B(185) | A(2.3) | A(3.8) | A |
| 7 | 7 | A | B | B(185) | A(2.3) | A(3.6 | B |
| 8 | 8 | A | A | B(185) | A(2.8) | B(5.0) | A |
| 9 | 9 | A | A | C(190) | A(2.8) | A(4.5) | A |
| 10 | 10 | A | A | C(190) | A(2.8) | A(4.1) | A |
| 11 | 11 | A | A | C(190) | A(4.4) | B(8.7) | A |
| 12 | 12 | A | A | C(190) | A(5.8) | B(9.8) | A |
| 13 | 13 | A | A | A(180) | B(6.0) | C(10.5) | A |
| 14 | 14 | A | A | A(180) | A(3.8) | B(6.9) | A |
| 15 | 15 | A | A | A(180) | B(6.4) | C(11.8) | A |
| 16 | 16 | A | A | C(190) | A(2.8) | A(4.8) | A |
| 17 | 17 | B | A | A(180) | A(3.9) | B(6.8) | A |
| 18 | 18 | C | A | A(180) | B(5.6) | C(10.0) | A |
| 19 | 19 | A | A | A(180) | A(4.9) | B(9.0) | A |
| 20 | 20 | A | A | A(180) | A(3.8) | B(6.0) | A |
| 21 | 21 | B | A | A(180) | B(5.0) | B(8.6) | A |
| 22 | 22 | A | A | C(190) | A(2.0) | A(4.0) | A |
| 23 | 23 | C | C | C(190) | A(2.2) | A(4.9) | B |
| 24 | 24 | A | C | C(190) | A(1.8) | A(3.2) | B |
| 25 | 25 | A | A | A(180) | C(14.0) | C(19.8) | A |
| 26 | 26 | A | A | A(180) | A(3.5) | B(7.5) | A |
| 27 | 27 | C | A | A(180) | C(11.0) | C(17.5) | A |
| CE 1 | 28 | A | A | D (200) | A(4.9) | B(9.0) | A |
| CE 2 | 29 | C | C | D (210) | A(4.0) | B(8.0) | B |
| CE 3 | 30 | C | C | D (200) | A(1.8) | A(4.0) | C |
| CE 4 | 31 | D | D | B(185) | C(15.0) | D(20.0) | C |
| CE 5 | 32 | D | D | A(180) | C(17.0) | D(23.5) | B |
| CE 6 | 33 | D | C | A(180) | D(20.0) | D(30.0) | B |

In the table 5, CE is Comparative Example.

Examples 2 to 27

Toners 2 to 27 were obtained by changing the toner particle in the Toner 1 Production Example as shown in Table 3. The production conditions for each toner are given in Table 3, and the properties of each toner are given in Table 4. The results of the evaluations carried out as in Example 1 are given in Table 5.

Comparative Examples 1 to 6

Toners 28 to 33 were obtained by changing the toner particle in the Toner 1 Production Example as shown in Table 3. The production conditions for each toner are given in Table 3, and the properties of each toner are given in Table 4. The results of the evaluations carried out as in Example 1 are given in Table 5.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-151594, filed Aug. 4, 2017, which is hereby incorporated by reference herein in its entirety.

What is claimed is:

1. A toner, comprising:

a toner particle containing a binder resin and a colorant;

the toner having an average circularity of at least 0.960; and the toner having an onset temperature Tε (° C.) of a storage elastic modulus E' of 50 to 70° C. as determined by a powder dynamic viscoelastic measurement, wherein a load X that provides the maximum value in a load region of 0.20 to 2.30 mN is 1.00 to 1.50 mN in a differential curve obtained by differentiation, by load, of a load-displacement curve provided by measuring the strength of the toner by a nanoindentation procedure with the horizontal axis being load (mN) and the vertical axis being displacement (μm).

2. The toner according to claim 1, wherein a value of a storage elastic modulus G' at Tε (° C.) is $2.0\times10^{7}$ to $1.0\times10^{10}$ Pa in a dynamic viscoelastic measurement of the toner.

3. The toner according to claim 1, wherein the binder resin contains a vinyl resin, the toner particle contains an amorphous polyester resin, and in a cross section of the toner particle observed with a transmission electron microscope, (i) the vinyl resin forms a matrix and the amorphous polyester resin forms a plurality of domains, and (ii) from a contour of the toner particle cross section, a percentage of the domains present in a region within 25% of the distance between the contour and a centroid of the cross section is 30 to 70 area % with reference to a total area of the domains.

4. The toner according to claim 3, wherein an acid value of the amorphous polyester resin is 1.0 to 10.0 mg KOH/g.

5. The toner according to claim 3, wherein a content of the amorphous polyester resin is 5.0 to 30.0 mass parts per 100 mass parts of the binder resin, and the amorphous polyester resin contains a polycondensate of an alcohol component and a carboxylic acid component that contains 10 to 50 mol % of a $C_{6-12}$ linear aliphatic dicarboxylic acid.

6. The toner according to claim 3, wherein in said cross section of the toner particle observed with a transmission electron microscope, from a contour of the toner particle cross section, the percentage of the domains of the amorphous polyester resin present in a region within 50% of the distance between the contour and the centroid of the cross section is 80 to 100 area % with reference to the total area of the domains.

7. The toner according to claim 3, wherein in said cross section of the toner particle observed with a transmission electron microscope, from the contour of the toner particle cross section, the area of the amorphous polyester resin domains present within 25% of the distance between the contour and the centroid of the cross section is at least 1.05 times the area of the amorphous polyester resin domains present at 25% to 50% of the distance between the contour of the cross section and the centroid of the cross section.

8. The toner according to claim 1, wherein a softening point of the toner is 115 to 140° C.

9. The toner according to claim 1, wherein the toner has inorganic fine particles, and a fixing ratio of the inorganic fine particles on the toner particle surface is 80 to 100%.

10. The toner according to claim 1, for which a relaxation enthalpy is not more than 2.5 J/g.

11. The toner according to claim 1, wherein the toner particle comprises a release agent, and the release agent contains a paraffin wax and an ester wax.

12. The toner according to claim 1, wherein the toner particle comprises a crystalline material.

13. The toner according to claim 1, wherein the toner particle comprises an ester wax.

* * * * *